US008953970B2

(12) United States Patent
Tanaka

(10) Patent No.: US 8,953,970 B2
(45) Date of Patent: Feb. 10, 2015

(54) IMAGE FORMING APPARATUS WITH A MOVABLE CLEANING MEMBER

(75) Inventor: Kuniaki Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 115 days.

(21) Appl. No.: 13/344,230

(22) Filed: Jan. 5, 2012

(65) Prior Publication Data

US 2013/0077988 A1 Mar. 28, 2013

(30) Foreign Application Priority Data

Sep. 22, 2011 (JP) ..... 2011-207875

(51) Int. Cl.
*G03G 15/02* (2006.01)

(52) U.S. Cl.
CPC .... *G03G 15/0291* (2013.01); *G03G 2215/0177* (2013.01); *G03G 2215/027* (2013.01)
USPC ..... 399/100; 399/171

(58) Field of Classification Search
CPC ..... G03G 15/02; G03G 15/0291; G03G 2215/026; G03G 2215/027; G03G 2215/028
USPC ..... 399/168, 170–173, 100
See application file for complete search history.

(56) References Cited

U.S. PATENT DOCUMENTS

| | | | | |
|---|---|---|---|---|
| 2006/0159484 | A1* | 7/2006 | Nakayama | 399/100 |
| 2007/0059026 | A1* | 3/2007 | Owens | 399/100 |
| 2010/0054793 | A1* | 3/2010 | Parks | 399/100 |

FOREIGN PATENT DOCUMENTS

| | | | | |
|---|---|---|---|---|
| JP | 63-267973 | A | | 11/1988 |
| JP | 04042248 | A | * | 2/1992 |
| JP | 06067516 | A | * | 3/1994 |
| JP | 06208279 | A | * | 7/1994 |
| JP | 8-62950 | A | | 3/1996 |
| JP | 10207178 | A | * | 8/1998 |
| JP | 2006184838 | A | * | 7/2006 |

* cited by examiner

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

An image forming apparatus has a latent image forming portion that includes a latent image supporting body, and a supporting member disposed at both ends of the latent image supporting body, a charging unit that includes a discharge electrode supplying electric charge to the latent image supporting body, and a control electrode controlling a potential of the latent image supporting body, a cleaning member that makes one end of the control electrode located at a stand-by position and is reciprocally moved so as to clean the control electrode, and a movement portion that moves the charging unit to a first position when charging the latent image supporting body, and moves the charging unit to a second position which is further spaced from the latent image forming portion than the first position when the control electrode is cleaned by the cleaning member.

7 Claims, 20 Drawing Sheets

IMAGE FORMING APPARATUS WITH A MOVABLE CLEANING MEMBER

CROSS-REFERENCE TO RELATED APPLICATIONS

This application is based on and claims priority under 35 USC 119 from Japanese Patent Application No. 2011-207875 filed Sep. 22, 2011.

BACKGROUND (i) Technical Field

The present invention relates to an image forming apparatus.

(ii) Related Art

In an image forming apparatus where a latent image is formed on an image supporting body, and a toner image is formed by supplying toner to the latent image, the outer circumferential surface of the image supporting body is charged by a charging unit.

Here, if charging is repeatedly performed by the charging unit, charging performance is deteriorated due to contamination in which corona products are attached to a grid electrode (an example of the control electrode) constituting the charging unit, and thus image quality is lowered.

SUMMARY

According to an aspect of the invention, there is provided an image forming apparatus having a latent image forming portion that includes a cylindrical latent image supporting body, and a supporting member disposed at both ends of the latent image supporting body and rotatably supporting the latent image supporting body; a charging unit that includes a discharge electrode supplying electric charge to the latent image supporting body due to discharge, and a control electrode disposed between the discharge electrode and the latent image supporting body and controlling a potential of the latent image supporting body, and that charges an outer circumferential surface of the latent image supporting body with a preset potential; a cleaning member that makes one end of the control electrode located at a stand-by position and is reciprocally moved along an axis direction of the latent image supporting body so as to clean the control electrode while coming into contact with the control electrode; and a movement portion that moves the charging unit to a first position with respect to the latent image forming portion when charging the latent image supporting body, and moves the charging unit to a second position which is further spaced from the latent image forming portion than the first position when the control electrode is cleaned by the cleaning member.

BRIEF DESCRIPTION OF THE DRAWINGS

Exemplary embodiments of the present invention will be described in detail based on the following figures, wherein.

DETAILED DESCRIPTION

Figure 1:
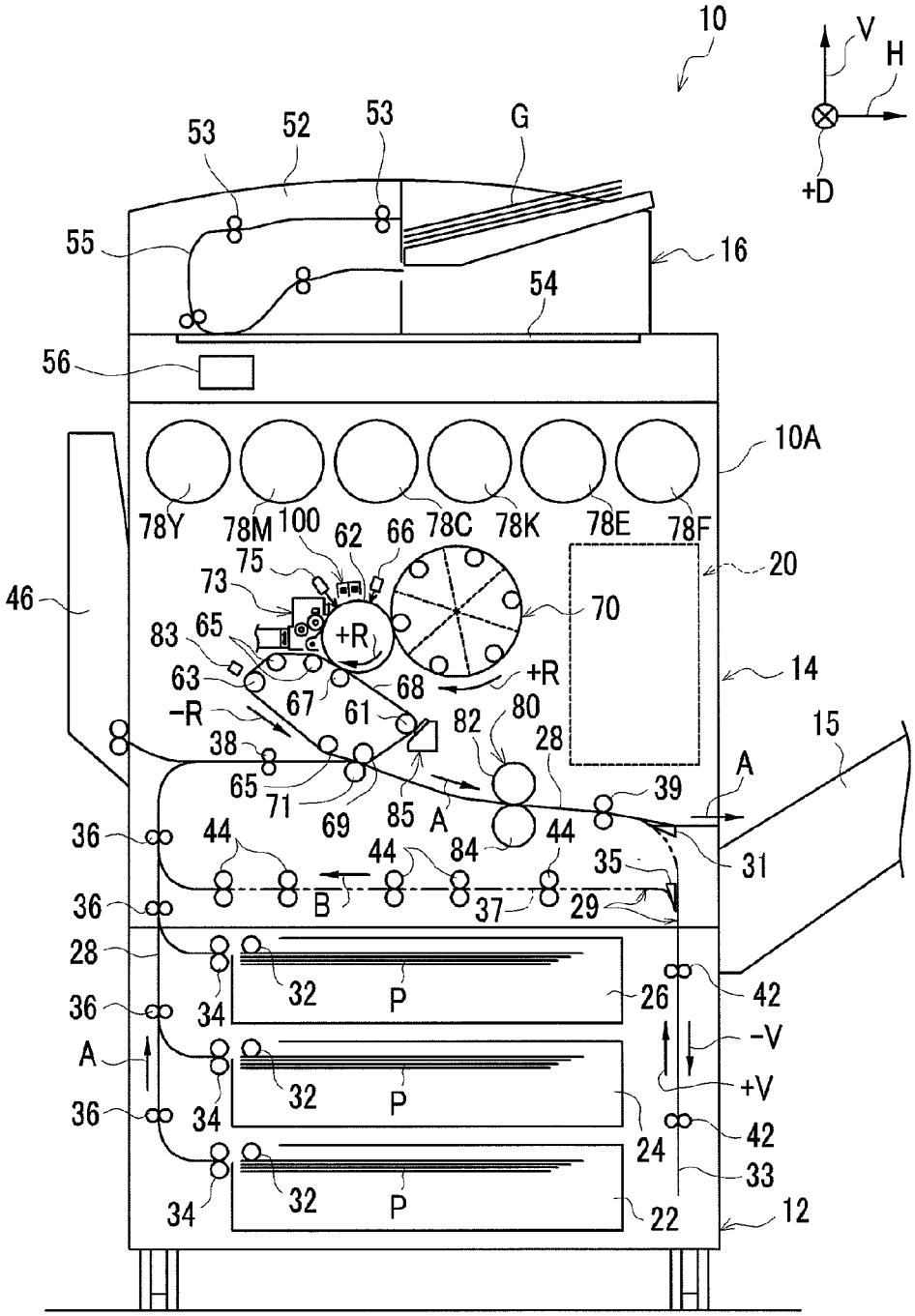
FIG. 1 is a diagram illustrating an overall image forming apparatus according to an exemplary embodiment of the invention.

Hereinafter, exemplary embodiments of the invention will be described in detail with reference to the accompanying drawings. In addition, in the drawings for describing the exemplary embodiments, the same constituent elements are basically given the same reference numerals, and repeated description will be omitted.

FIG. 1 shows an image forming apparatus 10 according to an exemplary embodiment of the invention.

The shown image forming apparatus 10 includes, from the lower side to the upper side in the vertical direction (arrow V direction), a paper accommodating portion 12 which accommodates recording paper P, an image forming portion 14 which is provided on the paper accommodating portion 12 and forms an image on the recording paper P supplied from the paper accommodating portion 12, a document reading portion 16 which is provided on the image forming portion 14 and reads a read document G, and a control portion 20 which is provided inside the image forming portion 14 and controls operations of the respective portions of the image forming apparatus 10. Further, in the following description, the up and down direction of an apparatus main body 10A of the image forming apparatus 10 is indicated by an arrow V direction, the left and right (horizontal) direction is indicated by an arrow H direction, and the depth (horizontal) direction is indicated by an arrow +D direction.

The paper accommodating portion 12 is provided with a first accommodating portion 22, a second accommodating portion 24, and a third accommodating portion 26 which accommodate sheets of recording paper P having different sizes as an example of the recording medium. Each of the first accommodating portion 22, the second accommodating portion 24, and the third accommodating portion 26 is provided with a delivery roller 32 which delivers the accommodated recording paper P to a transport path 28 installed in the image forming apparatus 10. A pair of transport rollers 34 and a pair of transport rollers 36 which transport a sheet of recording paper P are provided further on the downstream side on the transport path 28 than the delivery roller 32. Alignment rollers 38 which temporarily stop the recording paper P and deliver the recording paper P to a secondary transfer position described later at a determined timing are provided further on the downstream side on the transport path 28 than the transport rollers 36 in the transport direction of the recording paper P.

The upstream side part of the transport path 28 is provided in a straight line form from the left side of the paper accommodating portion 12 to the left lower part of the image forming portion 14 in the arrow V direction in the front view of the image forming apparatus 10. Further, the downstream side part of the transport path 28 is provided from the left lower end of the image forming portion 14 to a paper output portion 15 which is installed at the right side surface of the image forming portion 14. In addition, the transport path 28 is connected to a duplex transport path 29 on which the recording paper P is transported and reversed such that images are formed on both sides of the recording paper P.

The duplex transport path 29 is provided with a first switching member 31 which switches between the transport path 28 and the duplex transport path 29, a reversing portion 33 which is provided in a straight line shape in the arrow −V direction (downward in the figure) from the right lower end of the image forming portion 14 to the right side of the paper accommodating portion 12, a transport portion 37 which the rear end of the recording paper P transported to the reversing portion 33 enters and where the recording paper P is transported in the arrow H direction (leftward in the figure), and a second switching member 35 which switches between the reversing portion 33 and the transport portion 37, in the front view of the image forming apparatus 10. In addition, the reversing portion 33 is provided with plural pairs of transport rollers 42 at intervals, and the transport portion 37 is provided with plural pairs of transport rollers 44 at intervals.

The first switching member 31 is a member having a triangular prism shape, and a front end thereof is moved to one of the transport path 28 or the duplex transport path 29 by a driver (not shown), thereby switching the transport direction of the recording paper P. In the same manner, the second switching member 35 is a member having a triangular prism shape in the front view, and a front end thereof is moved to one of the reversing portion 33 or the transport portion 37 by a driver (not shown), thereby switching the transport direction of the recording paper P. In addition, the downstream side end of the transport portion 37 is connected to the front side of the transport rollers 36 which are located at the upstream side part of the transport path 28 by a guide member (not shown). Further, a folding type manual paper feeding portion 46 is provided at the left side surface of the image forming portion 14, and a connection is made from the manual paper feeding portion 46 to the front of the alignment rollers 38 on the transport path 28.

The document reading portion 16 is provided with a document transport device 52 which automatically transports a read document G by one sheet, a platen glass 54 which is disposed on the lower side of the document transport device 52 and places a read document G thereon, and a document reading device 56 which reads the read document G transported by the document transport device 52 or the read document G placed on the platen glass 54.

The document transport device 52 has an automatic transport path 55 at which plural pairs of transport rollers 53 are disposed, and a part of the automatic transport path 55 is disposed such that the read document G passes on the platen glass 54. In addition, the document reading device 56 reads the read document G transported by the document transport device 52 in a state of being stopped at the left end of the platen glass 54, or reads the read document G placed on the platen glass 54 while being moved in the arrow H direction.

On the other hand, the image forming portion 14 is provided with a cylindrical photoreceptor 62 as an example of the latent image supporting body at the center of the apparatus main body 10A. The photoreceptor 62 is rotated in the arrow +R direction (shown clockwise direction) by a driver (not shown), and supports an electrostatic latent image which is formed through light irradiation. In addition, a scorotron type charging unit 100 as an example of the charging unit which charges the surface of the photoreceptor 62 is provided on the upper side of the photoreceptor 62 and at a position facing the outer circumferential surface of the photoreceptor 62. Further, details of the charging unit 100 will be described later.

Figure 2:
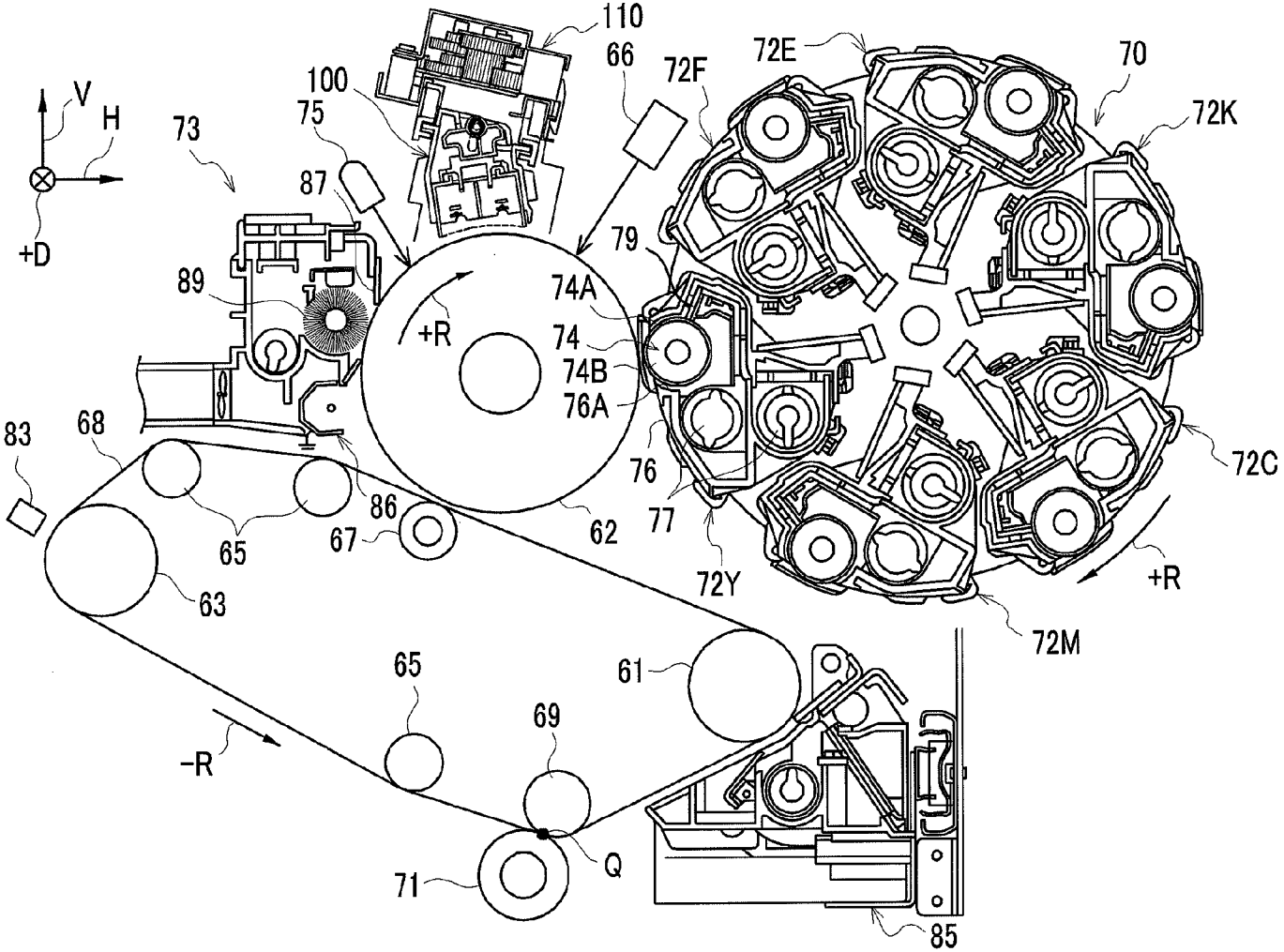
FIG. 2 is a configurational diagram of an image forming unit according to the exemplary embodiment of the invention.

As shown in FIG. 2, an exposure device 66 is provided further on the downstream side in the rotation direction of the photoreceptor 62 than the charging unit 100 and at the position facing the outer circumferential surface of the photoreceptor 62. The exposure device 66 includes LEDs (Light Emitting Diodes), and applies light (exposes) to the outer circumferential surface of the photoreceptor 62 which is charged by the charging unit 100 based on an image signal corresponding to each toner color, thereby forming an electrostatic latent image. Further, the exposure device 66 is not limited to the LED type, and, for example, may scan laser light using a polygon mirror.

A rotational change type development device 70 as an example of the developer which develops the electrostatic latent image formed on the outer circumferential surface of the photoreceptor 62 with set color toner so as to be visualized, is provided further on the downstream side in the rotation direction of the photoreceptor 62 than the part where exposure light is applied by the exposure device 66.

An intermediate transfer belt 68 onto which the toner image formed on the outer circumferential surface of the photoreceptor 62 is transferred is provided further on the downstream side in the rotation direction of the photoreceptor 62 than the development device 70 and on the lower side of the photoreceptor 62. The intermediate transfer belt 68 has an endless shape, and is wound on a driving roller 61 which is driven to be rotated by the control portion 20, a tension giving roller 63 which gives tension to the intermediate transfer belt 68, plural transport rollers 65 which come into contact with the rear surface of the intermediate transfer belt 68 and are rotated to follow the intermediate transfer belt 68, and an auxiliary roller 69 which comes into contact with the rear surface of the intermediate transfer belt 68 and is rotated to follow the intermediate transfer belt 68 at a secondary transfer position described later. In addition, the intermediate transfer belt 68 is circularly moved in the arrow −R direction (shown counterclockwise direction) through the rotation of the driving roller 61.

In addition, a primary transfer roller 67 which primarily transfers the toner image formed on the outer circumferential surface of the photoreceptor 62 onto the intermediate transfer belt 68 is provided at an opposite side to the photoreceptor with the intermediate transfer belt 68 interposed therebetween. The primary transfer roller 67 comes into contact with the rear surface of the intermediate transfer belt 68 at a position which is distant from the movement direction downstream side of the intermediate transfer belt 68 at the position where the photoreceptor 62 comes into contact with the intermediate transfer belt 68. Further, the primary transfer roller 67 is supplied with power from a power supply (not shown), and thereby primarily transfers the toner image on the photoreceptor 62 onto the intermediate transfer belt 68 by a potential difference with the photoreceptor 62 which is connected to the ground.

Moreover, a secondary transfer roller 71 as an example of the transfer portion which secondarily transfers the toner image which is primarily transferred onto the intermediate transfer belt 68 onto the recording paper P is provided at an opposite side to the auxiliary roller 69 with the intermediate transfer belt 68 interposed therebetween. A secondary transfer position (a position Q in FIG. 2) where the toner image is transferred onto the recording paper P is located between the secondary transfer roller 71 and the auxiliary roller 69. The secondary transfer roller 71 comes into contact with the front surface of the intermediate transfer belt 68. In addition, the secondary transfer roller 71 is supplied with power from a power supply (not shown), and thereby secondarily transfers the toner image on the intermediate transfer belt 68 onto the recording paper P by a potential difference with the auxiliary roller 69 which is connected to the ground.

Further, a cleaning device 85 which recovers remaining toner after the secondary transfer of the intermediate transfer belt 68 is provided at an opposite side to the driving roller with the intermediate transfer belt 68 interposed therebetween. In addition, a position detection sensor 83 which detects a preset reference position on the intermediate transfer belt 68 by detecting marks (not shown) attached to the surface of the intermediate transfer belt 68, and outputs a position detection signal which is used as a reference of start timing of an image forming process, is provided at a position opposite to the tension giving roller 63 around the intermediate transfer belt 68.

A cleaning device 73 which cleans remaining toner or the like which is not primarily transferred onto the intermediate transfer belt 68 but remains on the surface of the photoreceptor 62 is provided further on the downstream side in the rotation direction of the photoreceptor 62 than the primary transfer roller 67. The cleaning device 73 has a configuration where remaining toner or the like is recovered by a cleaning blade 87 and a brush roller 89 (refer to FIG. 2) which come into contact with the surface of the photoreceptor 62.

In addition, an electricity removal device 86 (refer to FIG. 2) which removes electricity by applying light to the outer circumferential surface of the photoreceptor 62 is provided at the upstream side of the cleaning device 73 in the rotation direction of the photoreceptor 62 (further on the downstream side than the primary transfer roller 67). The electricity removal device 86 removes electricity by irradiating the outer circumferential surface of the photoreceptor 62 with light before the cleaning device 73 recovers remaining toner or the like so as to reduce attachment force caused by static electricity, thereby increasing a recovery ratio of the remaining toner or the like. Further, an electricity removal lamp 75 which is an electricity remover after recovery of the remaining toner or the like is provided at the downstream side of the cleaning device 73 and at the upstream side of the charging unit 100.

The position where a toner image is secondarily transferred by the secondary transfer roller 71 is set in the course of the transport path 28 described above. Further on the downstream side than the secondary transfer roller 71 in the transport direction (indicated by the arrow A) of the recording paper P of the transport path 28, a fixing device 80 which fixes the toner image onto the recording paper P onto which the toner image is transferred by the secondary transfer roller 71 is provided.

The fixing device 80 includes a heating roller 82 having a heat source which is disposed on the toner image surface side (upper side) of the recording paper P and emits heat by being supplied with power, and a pressing roller 84 which is disposed on the lower side of the heating roller 82 and presses the recording paper P toward the outer circumferential surface of the heating roller 82. In addition, further on the downstream side than the fixing device 80 in the transport direction of the recording paper P of the transport path 28, transport rollers 39 which transport the recording paper P to the paper output portion 15 or the reversing portion 33 are provided.

On the other hand, on the lower side of the document reading device 56 and further on the upper side than the development device 70, toner cartridges 78Y, 78M, 78C, 78K, 78E and 78F which respectively accommodate toner of yellow (Y), magenta (M), cyan (C), black (K), a first special color (E), and a second special color (F) are provided sequentially in the arrow H direction so as to be replaceable. The first special color E and the second special color F are selected from special colors (including transparent) other than yellow, magenta, cyan, and black, or are not selected.

In the development device 70, in a case where the first special color E and the second special color F are selected, an image is formed using the six colors of Y, M, C, K, E, and F, and, in a case where the first special color E and the second special color F are not selected, an image is formed using the four colors of Y, M, C, and K. Further, although, in the exemplary embodiment, as an example, a case where an image is formed using the four colors of Y, M, C, and K and the first special color E and the second special color F are not used is described, an image may be formed using five colors of four colors of Y, M, C, K, and the first special color E or the second special color F as another example.

As shown in FIG. 2, the development device 70 is provided with developer units 72Y, 72M, 72C, 72K, 72E and 72F corresponding to the respective toner colors of yellow (Y), magenta (M), cyan (C), black (K), the first special color (E), and the second special color (F) which are disposed sequentially in the circumferential direction (in this order in the counterclockwise direction). The developer units 72Y, 72M, 72C, 72K, 72E and 72F which perform a development process are changed by being rotated by 60° with respect to the center angle by a motor (not shown) which is a rotation unit, and then face the outer circumferential surface of the photoreceptor 62. In addition, since the developer units 72Y, 72M, 72C, 72K, 72E and 72F have the same configuration, the developer unit 72Y will be described here, and description of the other developer units 72M, 72C, 72K, 72E and 72F will be omitted.

The developer unit 72Y has a case member 76 which is a main body, and the case member 76 is filled with a developer (not shown) including toner and carrier which are supplied from the toner cartridge 78Y (refer to FIG. 1) via a toner supply path (not shown). In addition, the case member 76 has a rectangular opening portion 76A so as to face the outer circumferential surface of the photoreceptor 62, and the opening portion 76A is provided with a development roller 74 of which the outer circumferential surface faces the outer circumferential surface of the photoreceptor 62. Further, a plate-shaped limitation member 79 which limits a layer thickness of the developer is provided at a part close to the opening portion 76A inside the case member 76 along the longitudinal direction of the opening portion 76A.

The development roller 74 includes a cylindrical development sleeve 74A which is rotatably installed and a magnetic member 74B which is constituted by plural magnetic poles fixed inside the development sleeve 74A. The development sleeve 74A is rotated so as to form a magnetic brush of the developer (carrier), and the limitation member 79 limits a layer thickness so as to form a developer layer on the outer circumferential surface of the development sleeve 74A. In addition, the developer layer on the outer circumferential surface of the development sleeve 74A is transported to a position facing the photoreceptor 62, and toner corresponding to a latent image (electrostatic latent image) formed on the outer circumferential surface of the photoreceptor 62 is attached thereto so as to perform development.

Further, two transport rollers 77 which have a spiral shape are rotatably disposed in parallel to each other in the case member 76. When the two transport rollers 77 are rotated, the developer filling the case member 76 is circularly transported in the axis direction of the development roller 74 (the longitudinal direction of the developer unit 72Y). In addition, the six development rollers 74 provided in the respective developer units 72Y, 72M, 72C, 72K, 72E and 72F are disposed in the circumferential direction such that the interval with the adjacent development roller 74 forms the center angle 60°. Therefore, the subsequent development roller 74 faces the outer circumferential surface of the photoreceptor 62 by the change of the developer units 72.

Next, an image forming process in the image forming apparatus 10 will be described.

As shown in FIG. 1, when the image forming apparatus 10 is operated, image data for respective colors of yellow (Y), magenta (M), cyan (C), black (K), the first special color (E), and the second special color (F) is sequentially output to the exposure device 66 from an image processing device (not shown) or an external device. At this time, as an example, in the development device 70, the developer unit 72Y (refer to FIG. 2) is rotated and held so as to face the outer circumferential surface of the photoreceptor 62.

Next, in the charging unit 100, the photoreceptor 62 is charged through corona discharge caused by a potential difference between charge wires 102A and 102B (refer to FIG. 3) as an example of the discharge electrode which is supplied with power and the photoreceptor 62 which is connected to the ground. At this time, a bias voltage is applied to a grid electrode 104 (refer to FIG. 3) as an example of the control electrode, and thereby a charge potential (discharge current) of the photoreceptor 62 is controlled so as to be in an allowable range.

Next, light emitted from the exposure device 66 according to the image data exposes the outer circumferential surface (surface) of the photoreceptor 62 charged by the charging unit 100, and an electrostatic latent image corresponding to the yellow image data is formed on the surface of the photoreceptor 62. In addition, the electrostatic latent image formed on the surface of the photoreceptor 62 is developed as a yellow toner image by the developer unit 72Y. Further, the yellow toner image on the surface of the photoreceptor 62 is transferred onto the intermediate transfer belt 68 by the primary transfer roller 67.

Next, as shown in FIG. 2, the development device 70 is rotated by 60° in the arrow +R direction, and thus the developer unit 72M faces the surface of the photoreceptor 62. In addition, the respective processes of the charging, the exposure, and the development are performed, and a magenta toner image on the surface of the photoreceptor 62 is transferred onto the yellow toner image on the intermediate transfer belt 68 by the primary transfer roller 67. In the same manner, cyan (C) and black (K) toner images, and first special color (E) and second special color (F) toner images according to further color settings are sequentially multilayer-transferred onto the intermediate transfer belt 68.

On the other hand, as shown in FIG. 1, the recording paper P which is delivered from the paper accommodating portion 12 and is transported to the transport path 28 is transported to the secondary transfer position (the position Q in FIG. 2) by the alignment rollers 38 in synchronization with the multilayer transfer of the respective toner images onto the intermediate transfer belt 68. In addition, the toner images which are multilayer-transferred onto the intermediate transfer belt 68 are secondarily transferred onto the recording paper P which is transported to the secondary transfer position, by the secondary transfer roller 71.

Next, the recording paper P onto which the toner images are transferred is transported toward the fixing device 80 in the arrow A direction (shown right direction). In addition, in the fixing device 80, the toner images are fixed to the recording paper P through heating and pressing performed by the heating roller 82 and the pressing roller 84. Further, the recording paper P to which the toner images are fixed is output to, for example, the paper output portion 15.

Further, when images are formed on both sides of the recording paper P, an image is fixed to the front surface by the fixing device 80, and then the front end and the rear end of the recording paper P are changed by delivering the recording paper P to the reversing portion 33 along the arrow −V direction and the arrow +V direction. The recording paper P is transported in the arrow B direction (shown left direction) by the duplex transport path 29, and is further transported to the transport path 28, and an image is formed on and is fixed to the rear surface of the recording paper P.

Next, the charging unit 100 and an installation structure of the charging unit 100 will be described.

Figure 3:
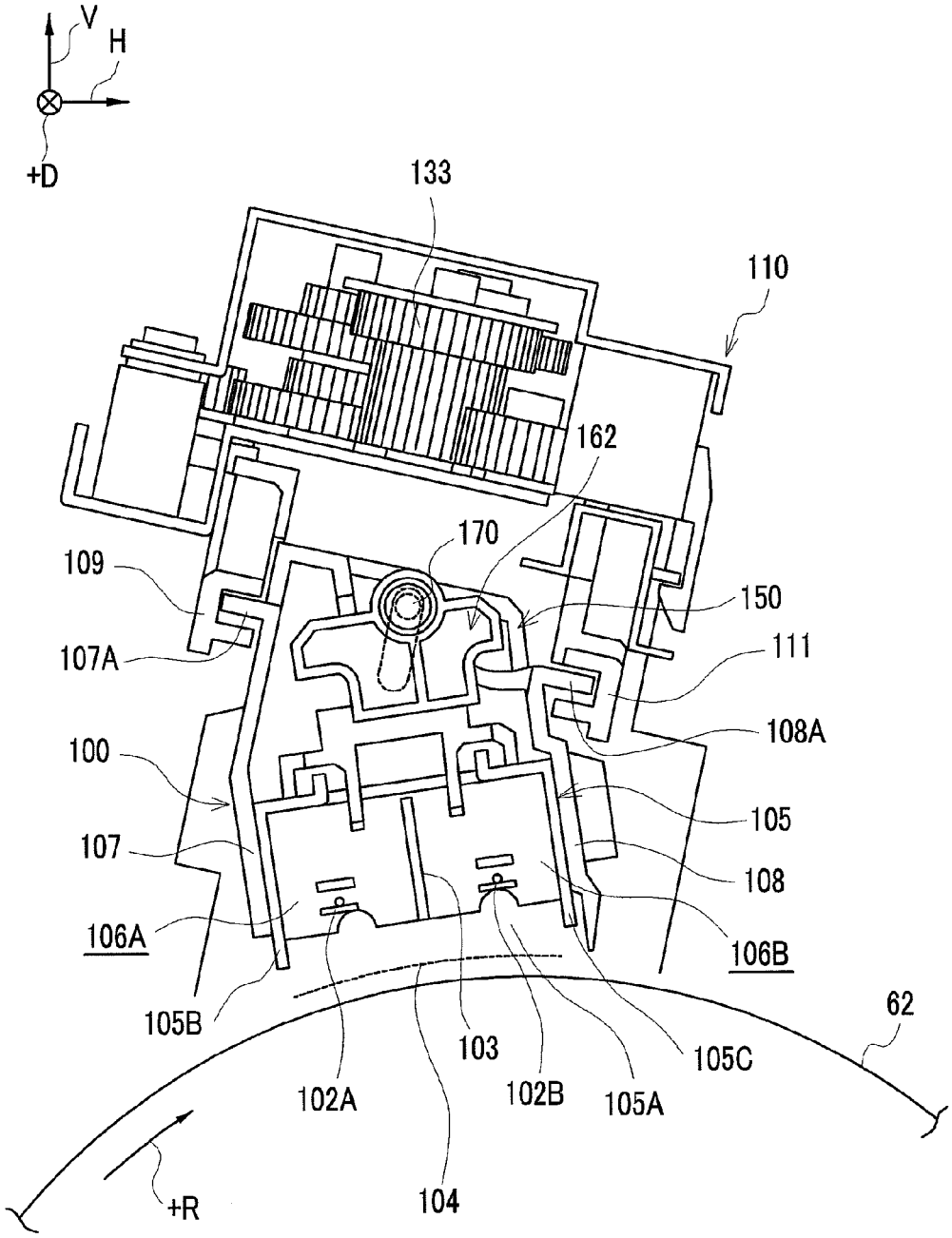
FIG. 3 is a diagram illustrating a configuration of the photoreceptor periphery according to the exemplary embodiment of the invention.

As shown in FIG. 3, the charging unit 100 includes a shield member 105 of which the H-V surface (cross-section) has a U shape. The inside of the shield member 105 is divided into a compartment 106A and a compartment 106B by a partition plate 103 which is disposed upright in the arrow +D direction as a longitudinal direction. Further, in the arrow +R direction, the compartment 106A is disposed at the upstream side, and the compartment 106B is disposed at the downstream side. In addition, as an example, an opening portion 105A of the shield member 105 is disposed to face the outer circumferential surface of the photoreceptor 62.

The charge wire 102A which is an example of the discharge electrode is built in the compartment 106A in the arrow +D direction as a long axis direction, and, in the same manner, the charge wire 102B which is an example of the discharge electrode is built in the compartment 106B in the arrow +D direction as the long axis direction. Further, the shield member 105 is provided with the grid electrode 104 which is an example of the control electrode so as to cover the opening portion 105A. The grid electrode 104 is disposed between the charge wires 102A and 102B and the outer circumferential surface of the photoreceptor 62 when viewed from the H-V surface. In addition, details of the grid electrode 104 and a grid cleaning portion 150 cleaning the grid electrode 104 will be described later.

Cover members 107 and 108 which stand upright in the arrow V direction are installed at the outer surfaces of a pair of side walls 105B and 1050 of the shield member 105 which are disposed so as to be opposite to each other in the arrow H direction. The upper end of the cover member 107 is bent outwardly (shown left side) in an L shape in the cross-section so as to form a flat plate-shaped guided portion 107A. Further, the upper end of the cover member 108 is bent outwardly (shown right side) in an L shape in the cross-section so as to form a flat plate-shaped guided portion 108A. The guided portions 107A and 108A are guided by guide rails 109 and 111 described later in the arrow +D direction, and are held in the arrow H and V directions (movement is restricted), whereby the charging unit 100 is disposed to face the outer circumferential surface of the photoreceptor 62.

Figure 4:
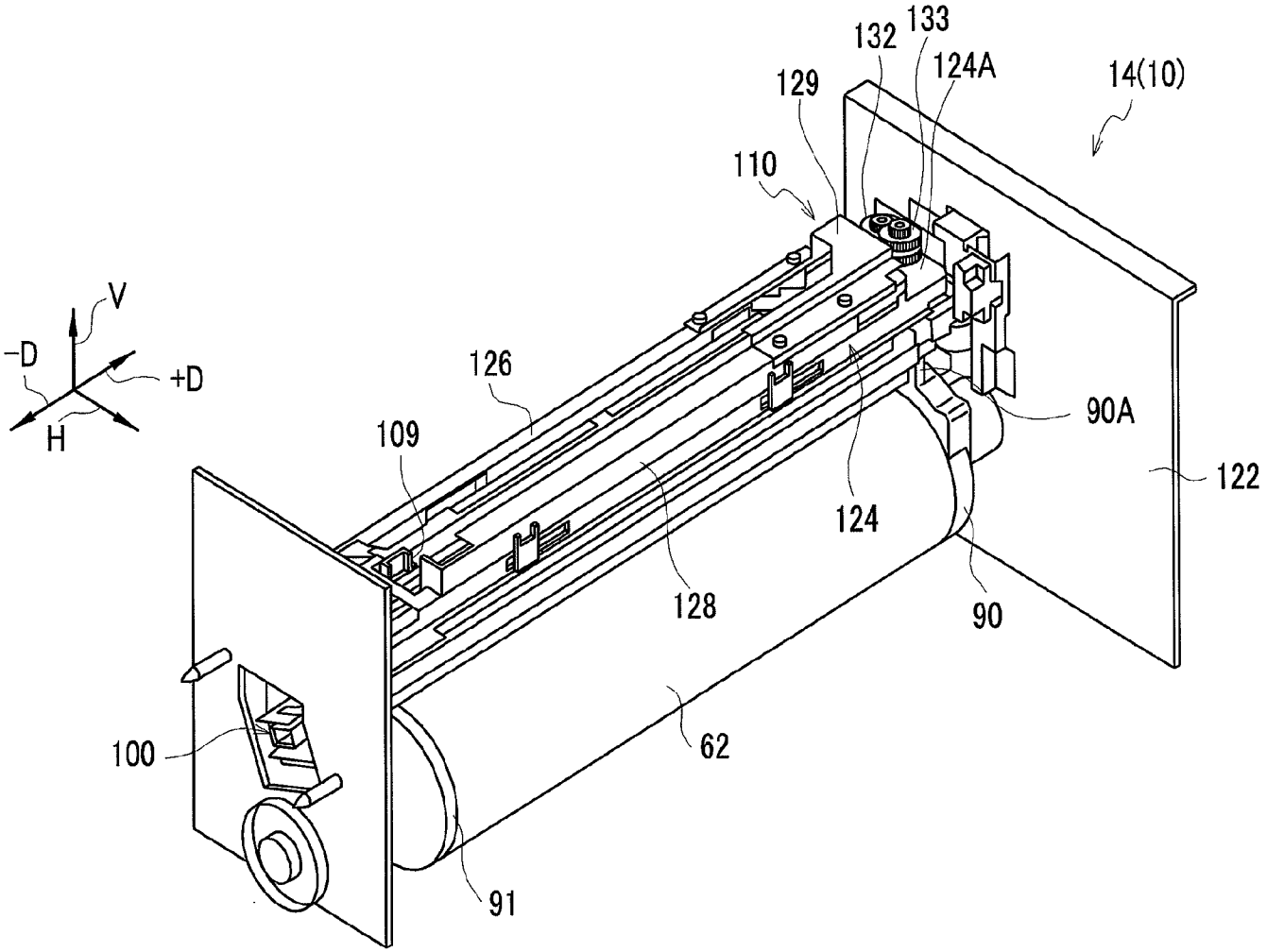
FIG. 4 is a perspective view illustrating a state where the photoreceptor and the charging unit are disposed according to the exemplary embodiment of the invention.

As shown in FIG. 4, housings 90 and 91 which are an example of the supporting member which rotatably supports the photoreceptor 62 are respectively disposed at both ends of the photoreceptor 62 in the axis direction, and the photoreceptor 62 and the housings 90 and 91 constitute a latent image forming portion.

Ribs 90A and 91A as an example of the pressing portion are formed at the photoreceptor 62 side of the housings 90 and 91. The upper end surfaces of the ribs 90A and 91A are bent to form convexes upwardly, and the centers of curvature thereof are common to the rotation center of the photoreceptor 62. In addition, the grid electrode 104 is pressed by the ribs 90A and 91A at a first position (described later in detail) where the outer circumferential surface of the photoreceptor 62 may be charged, and thus the photoreceptor 62 and the grid electrode 104 maintain a gap d (refer to FIG. 12).

Further, as shown in FIG. 4, an installation portion 110 where the charging unit 100 is installed is provided on the upper side of the photoreceptor 62 in the arrow V direction. The installation portion 110 includes a base plate 124, rectangular parallelepiped slide members 126 and 128 which are provided so as to be moved on the base plate 124 in the arrow +D direction (or −D direction), a motor 132 which is a driving source moving the slide members 126 and 128, and guide rails 109 and 111 (refer to FIG. 3) (an example of the movement portion) which are vertically moved in the arrow V direction due to the movement of the slide members 126 and 128.

A planarized portion 124A is formed at the other end of the base plate 124, and the motor 132 and a gear train 133 which transmits driving force of the motor 132 to the slide member 128 as described later are provided on the planarized portion 124A.

The slide member 126 is held so as to be moved in the arrow +D direction at the left end upper surface of the base plate 124 when the installation portion 110 is viewed in the arrow +D direction, and the slide member 128 is held so as to be moved in the arrow +D direction at the right end upper surface of the base plate 124 when the installation portion 110 is viewed in the arrow +D direction. In addition, a connection member 129 is fixed to the upper surface of the slide member 126 and the upper surface of the slide member 128 by screws. With the fixing of the connection member 129, the slide member 126 and the slide member 128 may be moved integrally in the arrow +D direction or in the arrow −D direction.

Figure 5A:
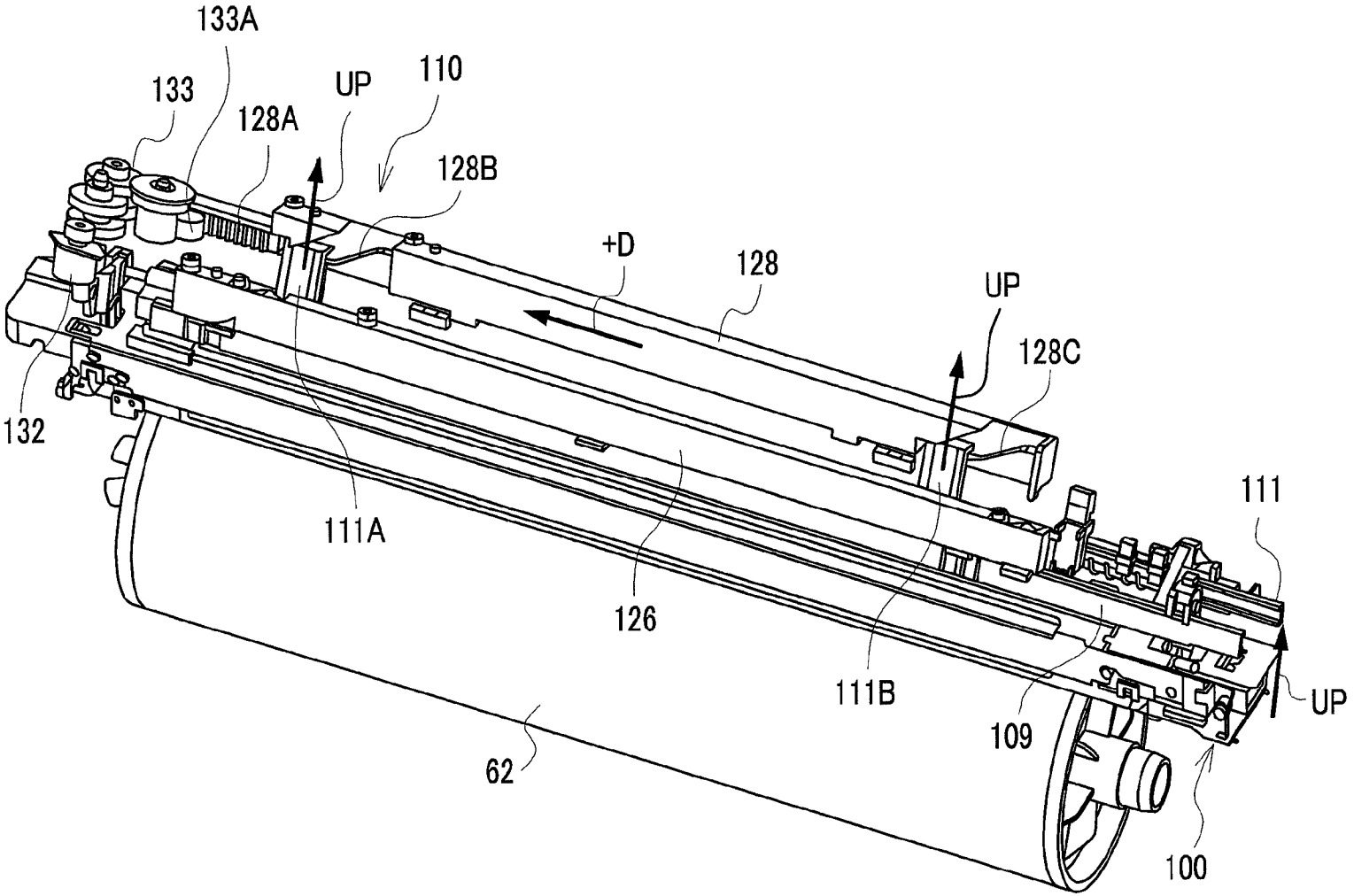
FIG. 5A is a diagram illustrating a state where the charging unit is close to the photoreceptor according to the exemplary embodiment of the invention.
Figure 5B:
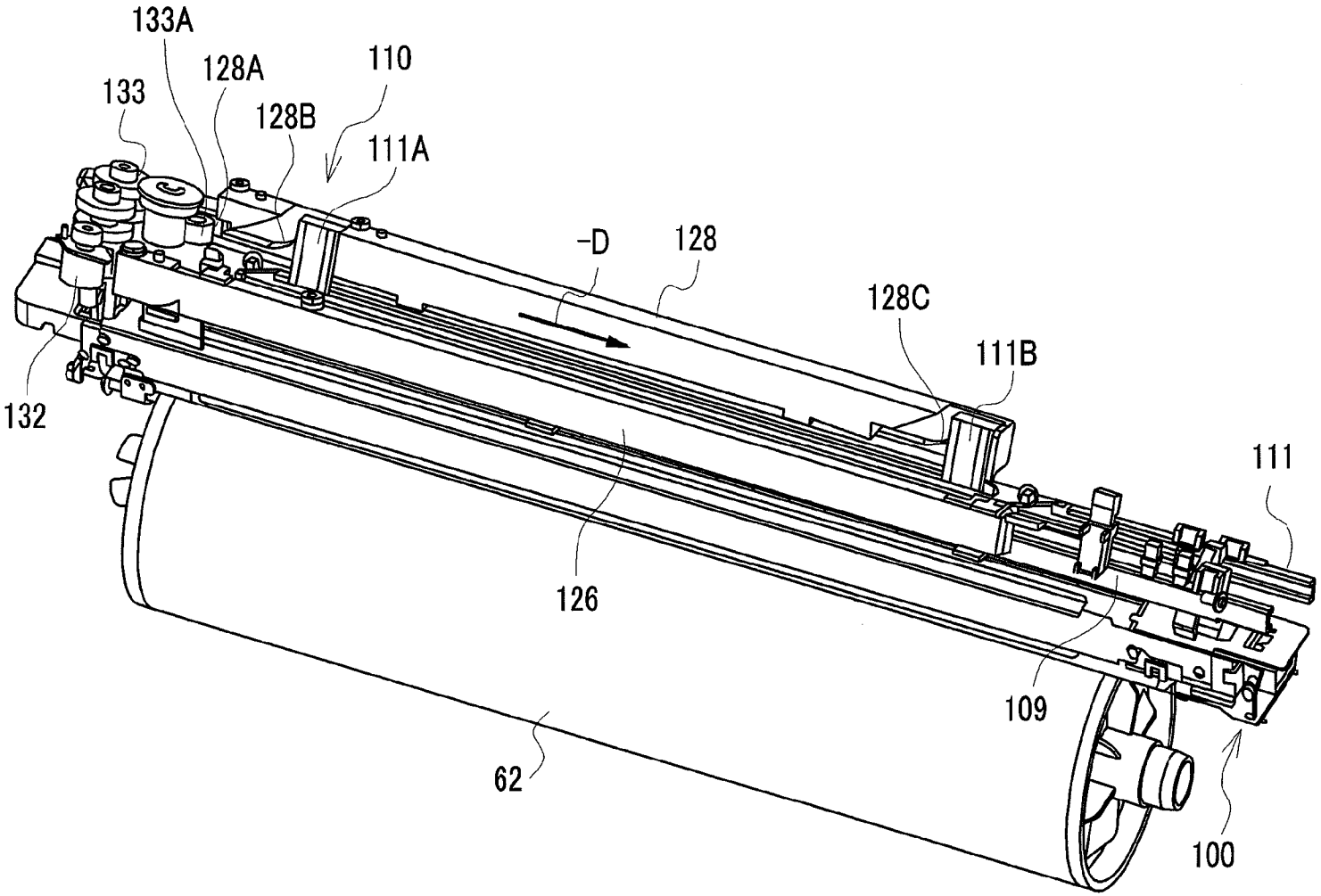
FIG. 5B is a diagram illustrating a state where the charging unit is separated from the photoreceptor according to the exemplary embodiment of the invention.

As shown in FIGS. 5A and 5B, the slide member 128 is provided with a rack portion 128A formed at the gear train 133 side and cam portions 128B and 128C formed at intervals in the arrow +D direction. The rack portion 128A meshes with a pinion 133A which is one of gear wheels constituting the gear train 133, and is thereby moved linearly in the arrow +D direction or the arrow −D direction due to the rotation of the pinion 133A. In addition, each of the cam portions 128B and 128C includes a slant portion which slants downwardly so as to be tilted with respect to the arrow +D direction, and an upper planarized portion and a lower planarized portion which are formed continuously on the upper end and the lower end of the slant portion.

The guide rail 111 which guides the charging unit 100 in the arrow +D direction and holds the charging unit 100 on the photoreceptor 62 is provided on the lower side of the slide member 128. The guide rail 111 is provided with hook portions 111A and 111B at intervals in the arrow +D direction. The hook portions 111A and 111B have a reverse L shape in the cross-section when viewed from the arrow +D direction, and the planarized portions located at the upper end are hooked to the cam portions 128B and 128C of the slide member 128. In addition, the hook portions 111A and 111B are located at the lower end of the cam portions 128B and 128C during image formation.

With the configuration, when the slide member 128 is moved in the arrow +D direction by the rotation of the pinion 133A, the hook portions 111A and 111B are moved upwardly (the arrow UP direction) along the slant surfaces of the cam portions 128B and 128C, and the guide rail 111 is moved in the arrow UP direction.

Meanwhile, in the same manner as the slide member 128, the slide member 126 is also provided with cam portions (not shown) which slant downwardly so as to be tilted with respect to the arrow +D direction, and hook portions (not shown) installed in the guide rail 109 are hooked to the cam portions. Further, since the slide member 126 is not provided with a rack but is integrally formed with the slide member 128 by the connection member 129 (refer to FIG. 4), the slide member 128 is moved in the arrow +D direction and the slide member 126 is simultaneously moved in the arrow +D direction. Thereby, the hook portions are moved upwardly along the cam portions, and the guide rail 109 is moved in the arrow UP direction.

As such, when the slide members 126 and 128 are moved in the arrow +D direction, the guide rails 109 and 111 are moved in the arrow UP direction, the charging unit 100 held by the guide rails 109 and 111 is moved in the arrow UP direction with respect to the outer circumferential surface of the photoreceptor 62.

Here, as shown in FIG. 5A, the charging unit 100 locates the slide members 126 and 128 in the arrow −D direction with respect to the base plate 124 (refer to FIG. 4) during image formation, and thus the outer circumferential surface of the photoreceptor 62 is held at a position (the first position) where it may be charged. Further, when the grid electrode 104 (refer to FIG. 6A) described later is cleaned, and the charging unit 100 is added to and deleted from the image forming portion 14 (refer to FIG. 1), if the slide members 126 and 128 are moved in the arrow +D direction with respect to the base plate 124 (refer to FIG. 4), the guide rails 109 and 111 rise. Therefore, as shown in FIG. 5B, the charging unit 100 is held at a position (second position) which is further spaced from the photoreceptor 62 than the first position which is a position where the outer circumferential surface of the photoreceptor 62 is charged. In addition, in FIGS. 5A and 5B, the base plate 124 (refer to FIG. 4) is not shown.

Figure 6A:
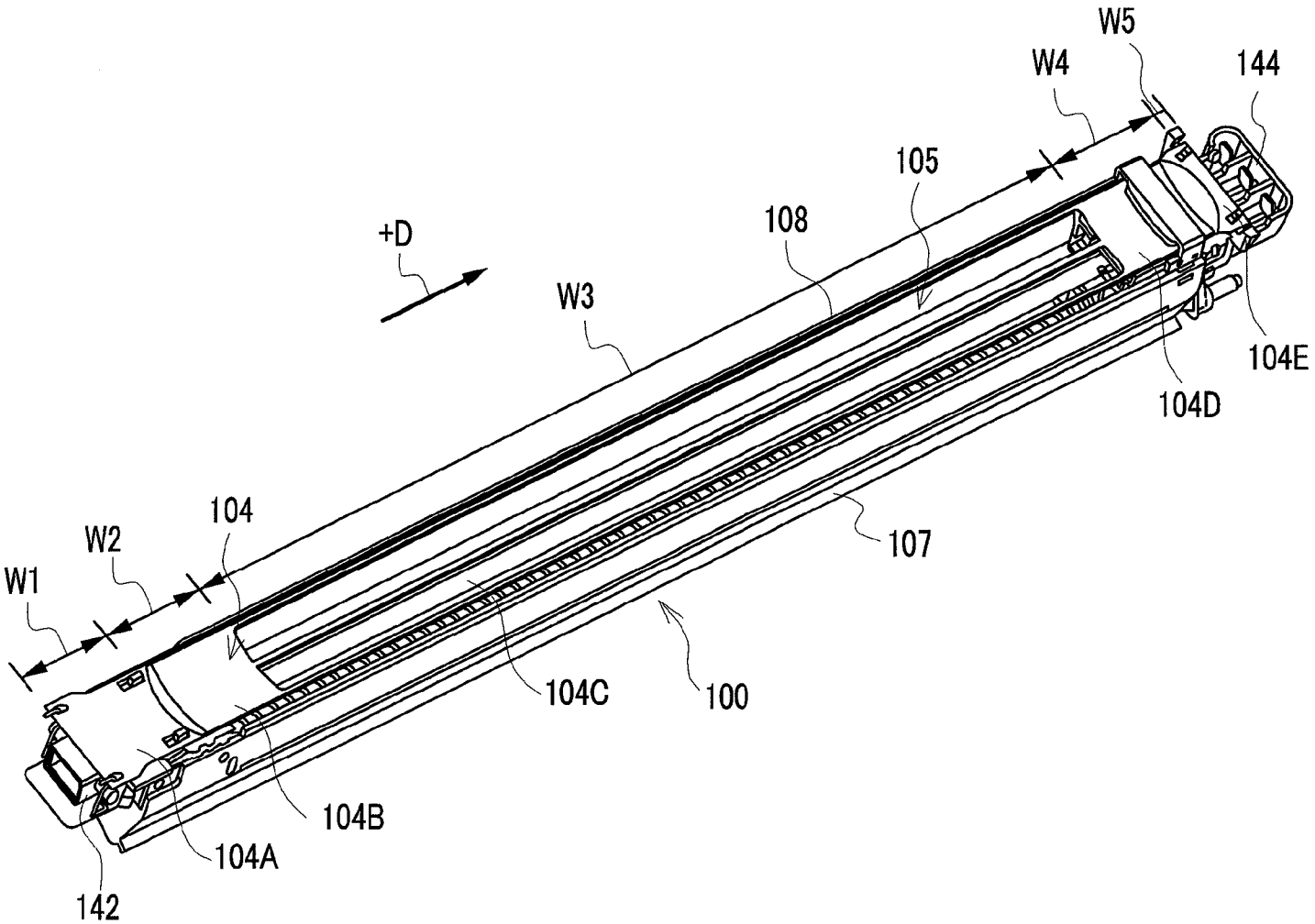
FIG. 6A is a perspective view of the charging unit according to the exemplary embodiment of the invention.

As shown in FIG. 6A, in the charging unit 100, installation members 142 and 144 are installed at both ends of the shield member 105 in the arrow +D direction. The installation members 142 and 144 are members for installing the grid electrode 104, and the installation member 142 is disposed on the front side in the arrow +D direction, and the installation member 144 is disposed on the back side in the arrow +D direction.

On the other hand, the grid electrode 104 has a rectangular shape in plan view, and, has a configuration where an installation portion 104A with the width W1, a non-electrode portion 104B with the width W2, an electrode portion 104C with the width W3, a non-electrode portion 104D with the width W4, and an installation portion 104E with the width W5 are integrally formed from the front side to the back side in the arrow +D direction.

Further, the grid electrode 104 is curved when viewed from an S-T surface (refer to FIG. 7B) described later through drawing (stamping) of a flat plate. That is, in the grid electrode 104, the non-electrode portion 104B, the electrode portion 104C, and the non-electrode portion 104D are bent so as to form, for example, a convex shape toward the charge wires 102A and 102B (refer to FIG. 3), and the installation portions 104A and 104E are planarized. In addition, as shown in FIG. 7B, the curvature of the non-electrode portion 104B, the electrode portion 104C, and the non-electrode portion 104D is set such that the gap d with the outer circumferential surface of the photoreceptor 62 is the same as the circumferential direction of the photoreceptor 62, that is, they are bent along the outer circumferential surface of the photoreceptor 62.

Figure 6B:
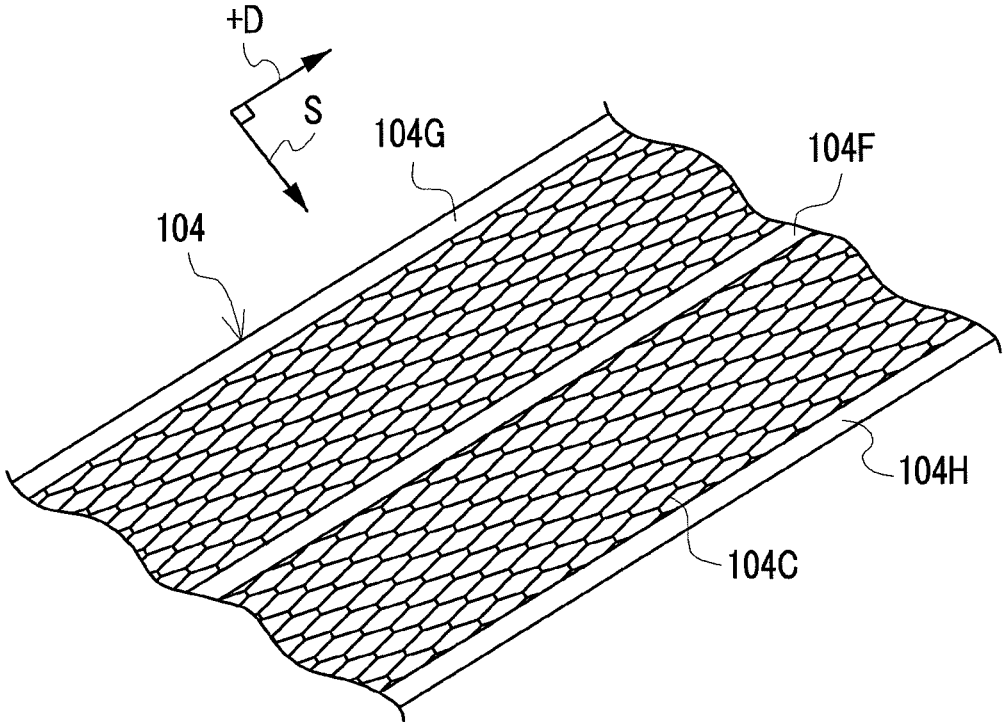
FIG. 6B is a diagram illustrating a shape of the electrode portion of the grid electrode according to the exemplary embodiment of the invention.

As shown in FIG. 6B, the electrode portion 104C of the grid electrode 104 has a mesh shape which is formed of plural hexagonal holes, and, in order to increase stiffness, the frame 104F, and the frames 104G and 104H are respectively provided at the center and both ends in the arrow S direction which is a transverse direction perpendicular to the arrow +D direction. In addition, the outermost parts of the frames 104G and 104H in the arrow S direction are coplanar with the planarized portions 104A and 104E. In addition, the electrode portion 104C is surrounded by the frame 104G, the non-electrode portion 104B, the frame 104F, and the non-electrode portion 104D, and is surrounded by the frame 104F, the non-electrode portion 104B, the frame 104H, and the non-electrode portion 104D, and thus the electrode portion 104C is divided into two regions. Further, the hexagonal holes of the electrode portion 104C are shown only in FIG. 6B, and are not shown in the other figures.

Figure 7A:
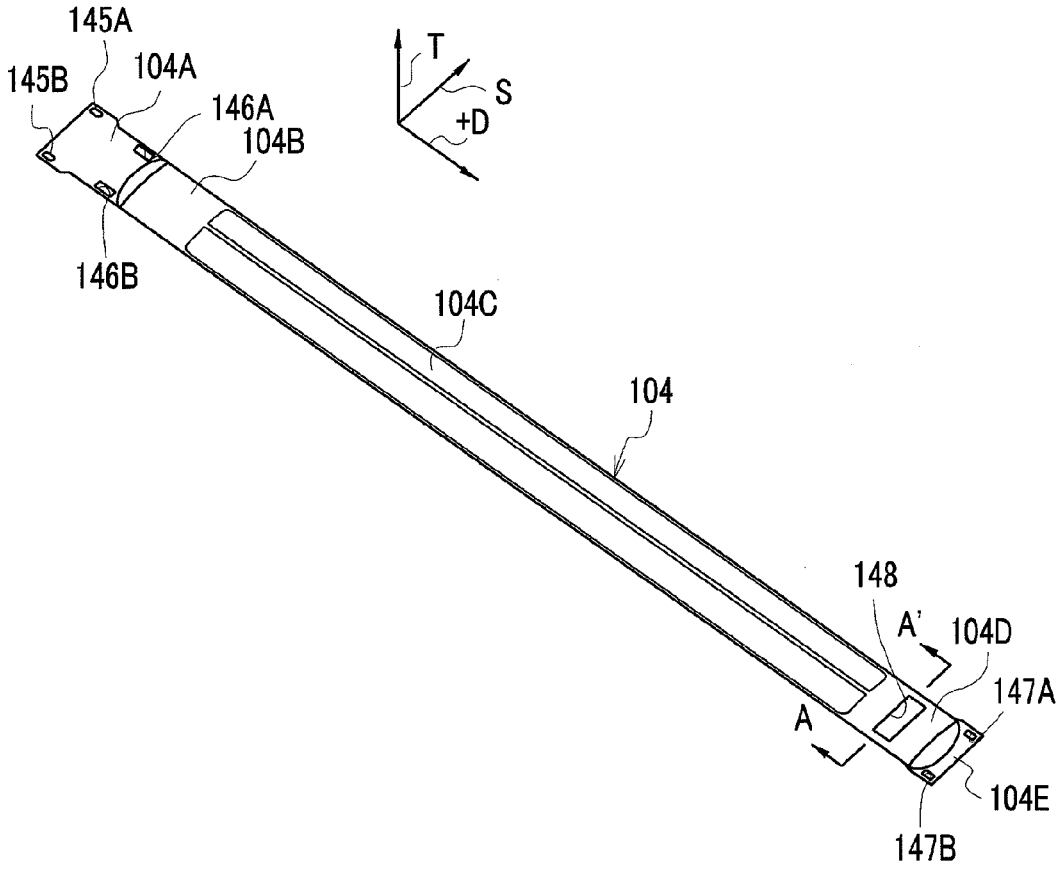
FIG. 7A is a perspective view illustrating an overall configuration of the grid electrode according to the exemplary embodiment of the invention.

As shown in FIG. 7A, the installation portion 104A of the grid electrode 104 is provided with installation holes 145A and 145B which are through-holes penetrated in the arrow T direction (thickness direction) perpendicular to the arrow +D direction and the arrow S direction, and guide holes 146A and 146B. The installation holes 145A and 145B are respectively formed to have a rectangular shape at one end of the grid electrode 104 at intervals in the arrow S direction, and the guide holes 146A and 146B are adjacent to the non-electrode portion 104B and are respectively formed to have a rectangular shape at intervals in the arrow S direction. Further, in the installation portion 104E, installation holes 147A and 147B which are through-holes penetrated in the arrow T direction are respectively formed to have a rectangular shape at the other end of the grid electrode 104 at intervals in the arrow S direction.

Figure 7B:
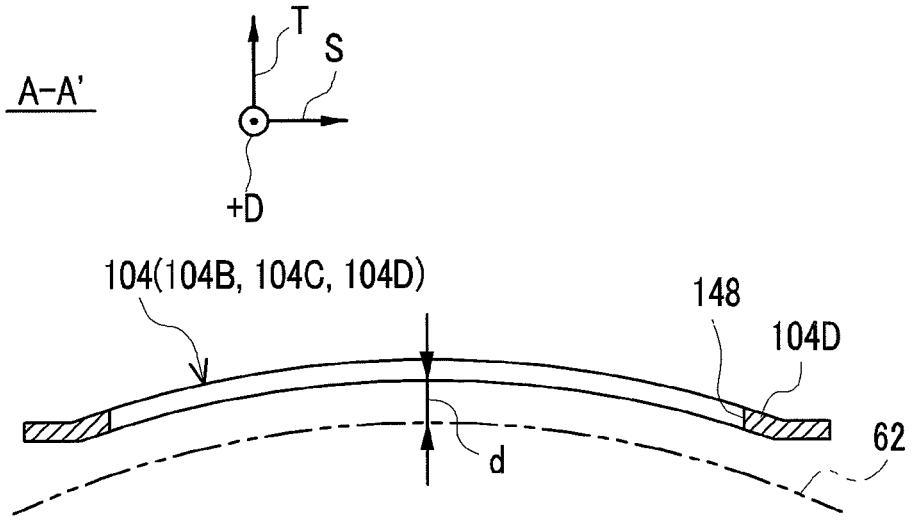
FIG. 7B is a cross-sectional view of the grid electrode in the transverse direction according to the exemplary embodiment of the invention.

As shown in FIGS. 7A and 7B, the non-electrode portion 104D is provided with a through-hole 148 which is penetrated in the arrow T direction in a rectangular shape which has the arrow S direction as a longitudinal direction. The size of the through-hole 148 has a size which allows cleaning pads 166 and 172 described later to pass in the arrow T direction.

Figure 8A:
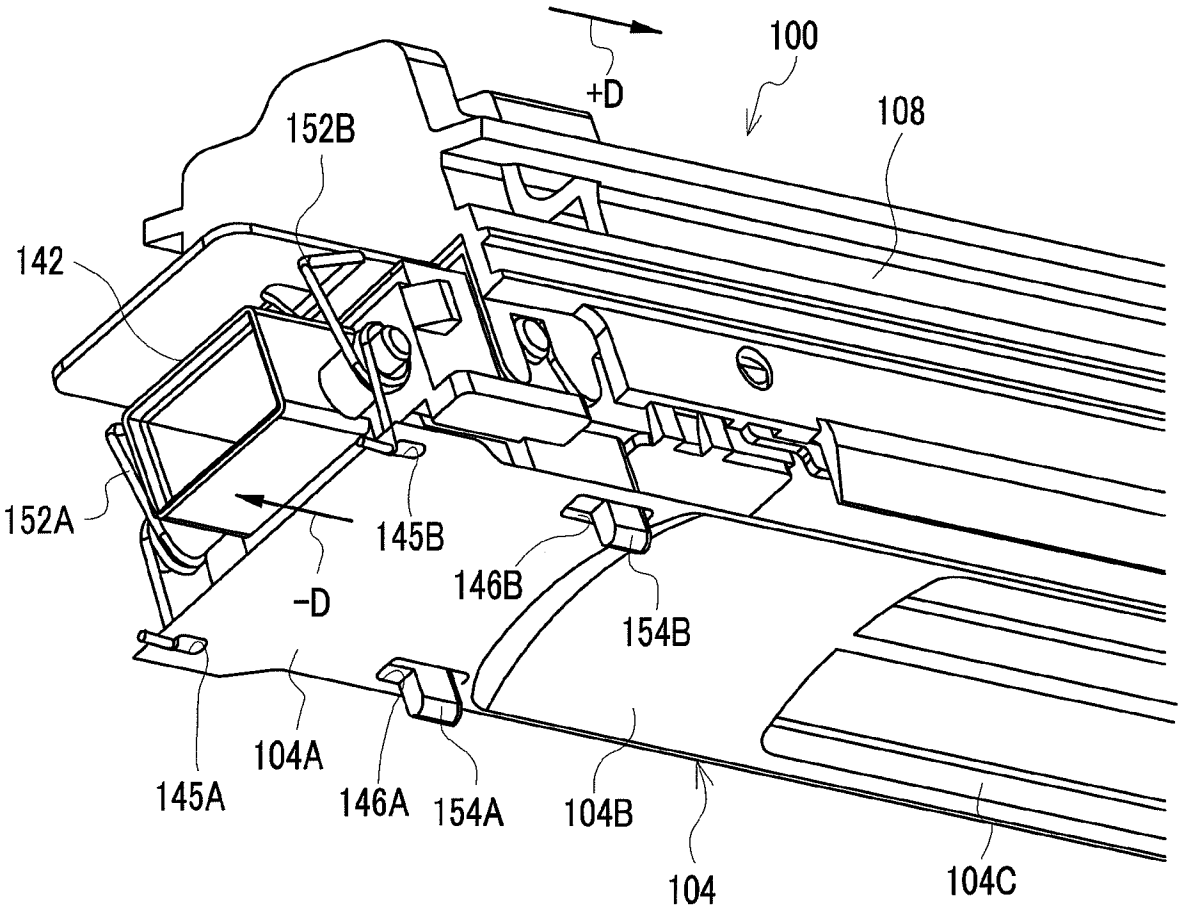
FIG. 8A is a configurational diagram illustrating one end of the charging unit according to the exemplary embodiment of the invention.

As shown in FIG. 8A, the installation member 142 is provided with spring members 152A and 152B which bias the grid electrode 104 in the arrow −D direction, and protrusions 154A and 154B which protrude downwardly. The spring members 152A and 152B use, for example, torsion springs, and one ends thereof are fixed to the installation member 142, and the other ends thereof are hooked to the edges of the installation holes 145A and 145B of the grid electrode 104. Further, the protrusions 154A and 154B are inserted into the guide holes 146A and 146B of the grid electrode 104, and protrude downwardly.

Figure 8B:
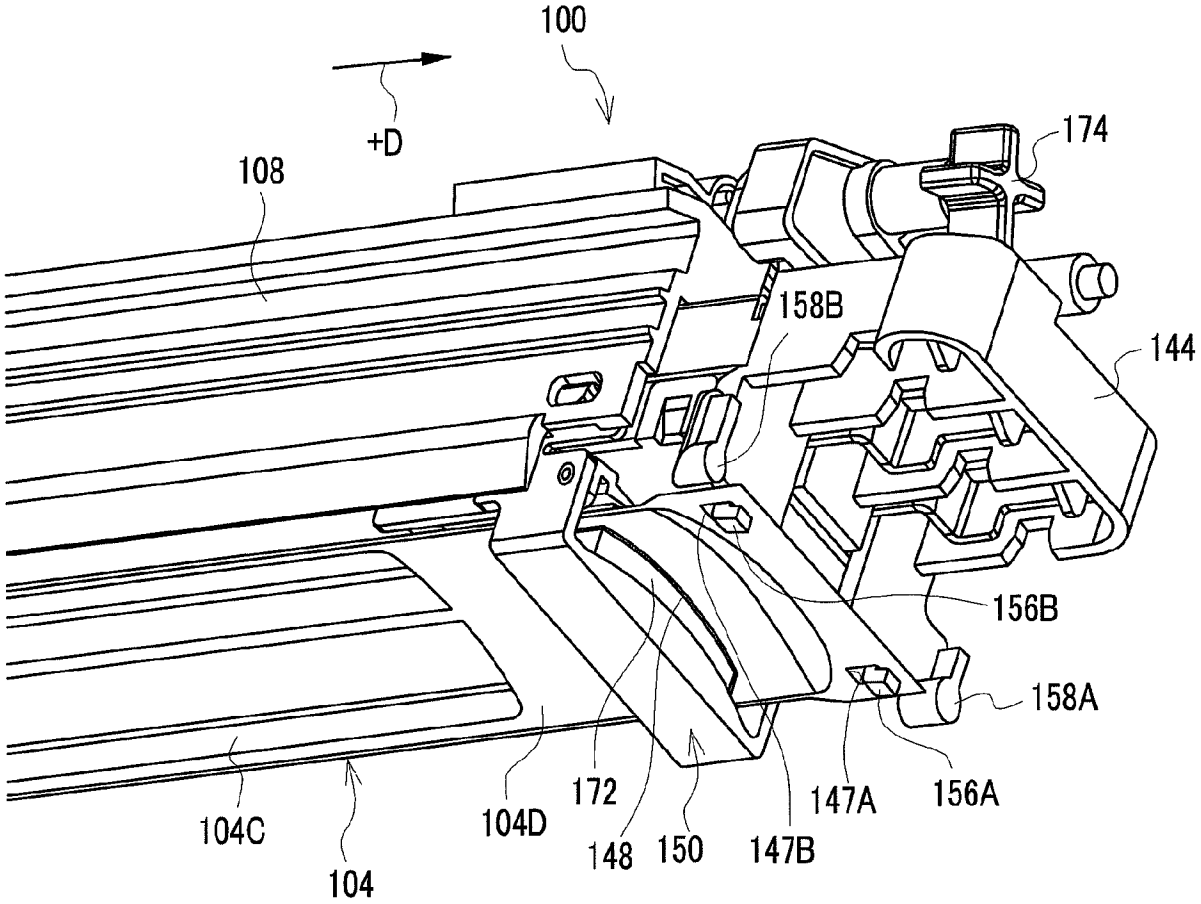
FIG. 8B is a configurational diagram illustrating the other end of the charging unit according to the exemplary embodiment of the invention.

On the other hand, as shown in FIG. 8B, hook portions 156A and 156B for fixing the other end of the grid electrode 104 and protrusions 158A and 158B protruding downwardly are provided at the bottom of the installation member 144. The hook portions 156A and 156B are bent in the arrow +D direction, and have sizes which may be inserted into the installation holes 147A and 147B of the grid electrode 104. Further, the protrusions 158A and 158B are provided outside the grid electrode 104 in the transverse direction of the grid electrode 104 and protrude downwardly.

Here, as shown in FIGS. 8A and 8B, the spring members 152A and 152B are hooked to the installation holes 145A and 145B of the grid electrode 104; the protrusions 154A and 154B pass through the guide holes 146A and 146B; the hook portions 156A and 156B are hooked to the installation holes 147A and 147B by pulling the grid electrode 104 in the arrow +D direction; and thereby the grid electrode 104 is installed in the charging unit 100.

Next, the grid cleaning portion 150 will be described.

Figure 9A:
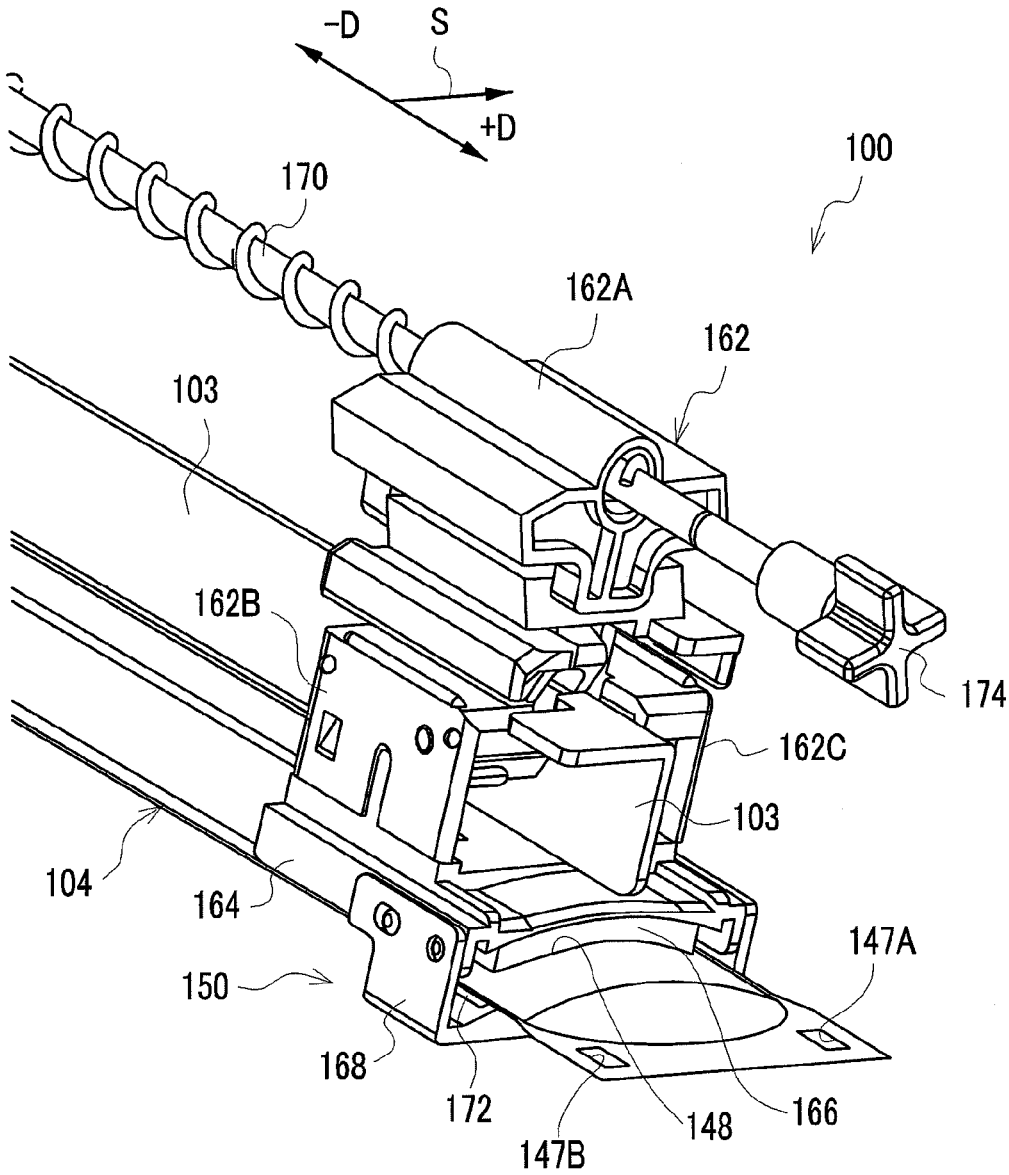
FIGS. 9A and 9B are a perspective view and a cross-sectional view illustrating a grid cleaning portion of the charging unit according to the exemplary embodiment of the invention, respectively.

As shown in FIG. 9A, a lead shaft 170 is rotatably provided inside the charging unit 100 in the arrow +D direction which is an axis direction. A cross-shaped coupling portion 174 is provided at the end of the lead shaft 170, and the coupling portion 174 is fitted into the other coupling portion (not shown) provided on the side plate 122 (refer to FIG. 4) side. In addition, when the other coupling portion is rotated by the motor (not shown), the lead shaft 170 is rotated.

In addition, the grid cleaning portion 150 which is moved in the arrow +D direction or the arrow −D direction by the rotation of the lead shaft 170 is provided inside the charging unit 100. The grid cleaning portion 150 includes a base holder 162 through which the lead shaft 170 passes, a wire holder 164 which is installed at the lower part of the base holder 162, a pad holder 168 which is installed at the lower part of the wire holder 164, a cleaning pad 166 as an example of the cleaning member which cleans the upper surface of the grid electrode 104, and a cleaning pad 172 as an example of the cleaning member which cleans the lower surface (the surface facing the photoreceptor 62 (refer to FIG. 2)) of the grid electrode 104.

A cylindrical portion 162A having spiral grooves (not shown) inside is integrally formed at the upper part of the base holder 162. The lead shaft 170 passes through the cylindrical portion 162A, and convexes on the outer circumference of the lead shaft 170 come into contact with the grooves inside the cylindrical portion 162A. In this manner, when the lead shaft 170 is normally or reversely rotated, the base holder 162 is moved in the arrow −D direction or in the arrow +D direction. Further, side walls 162B and 162C which protrude downwardly and stand upright are formed at both ends of the lower part of the base holder 162 in the arrow S direction. The shield member 105 (refer to FIG. 9B) is disposed outside the side walls 162B and 162C.

Figure 9B:
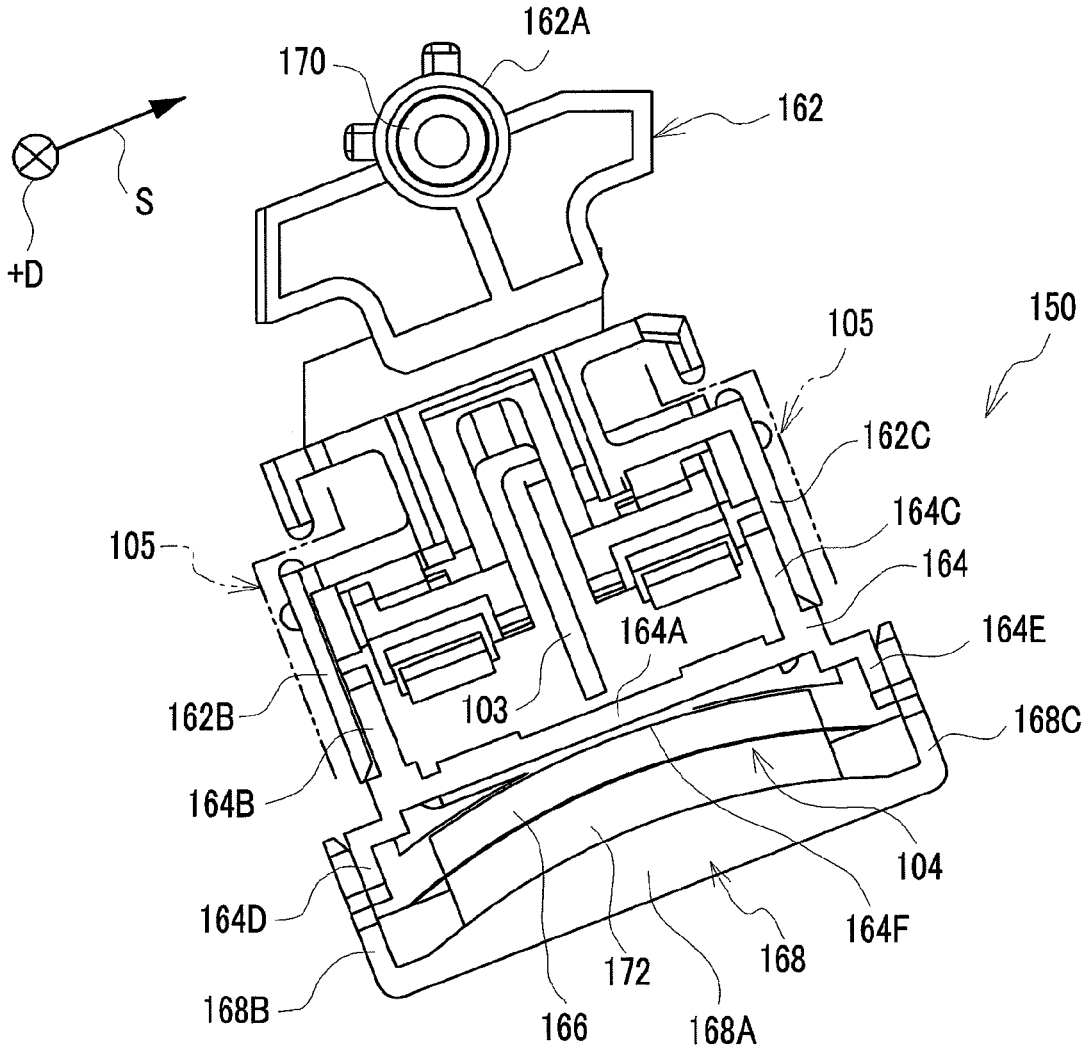

As shown in FIG. 9B, the wire holder 164 has a flat plate-shaped main body portion 164A, and side walls 164B and 164C opposite to each other are formed on the upper surface of the main body portion 164A at intervals in the arrow S direction. The side walls 164B and 164C are installed in the side walls 162B and 162C of the base holder 162 through concave and convex fitting. In addition, side walls 164D and 164E which protrude downwardly are integrally formed at both ends of the lower surface of the main body portion 164A in the arrow S direction. A recessed portion 164F of which the upper side is curved so as to be convex is provided between the side wall 164D and the side wall 164E (central part) in the arrow S direction. Further, the cleaning pad 166 is fixed to the recessed portion 164F through adhesion.

The pad holder 168 has a convex portion 168A of which the center of the upper side in the arrow S direction is curved so as to be convex, and side walls 168B and 168C which are opposite to each other at intervals in the arrow S direction are formed at both ends of the convex portion 168A in the arrow S direction. The side walls 168B and 168C are installed in the side walls 164D and 164E of the wire holder 164 through concave and convex fitting. In addition, the cleaning pad 172 is fixed to the convex portion 168A through adhesion. The cleaning pads 166 and 172 include, for example, polyurethane which is a foamable resin material.

Figure 10A:
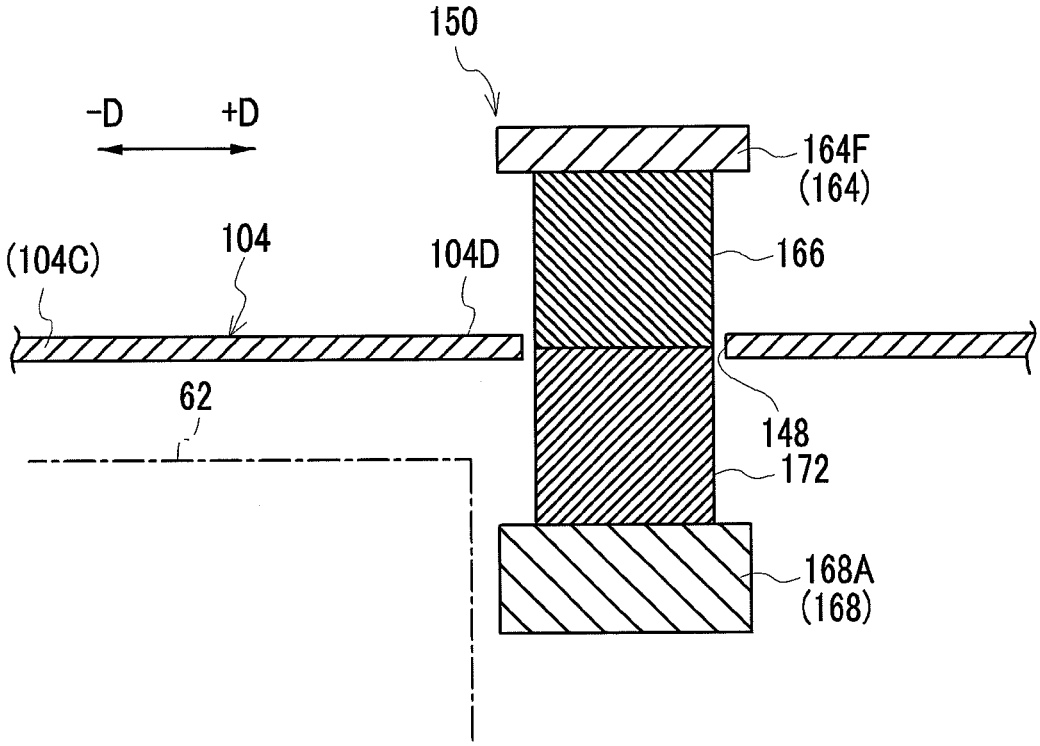
FIGS. 10A and 10B are cross-sectional views illustrating a state where the cleaning pad cleans the grid electrode according to the exemplary embodiment of the invention.
Figure 11A:
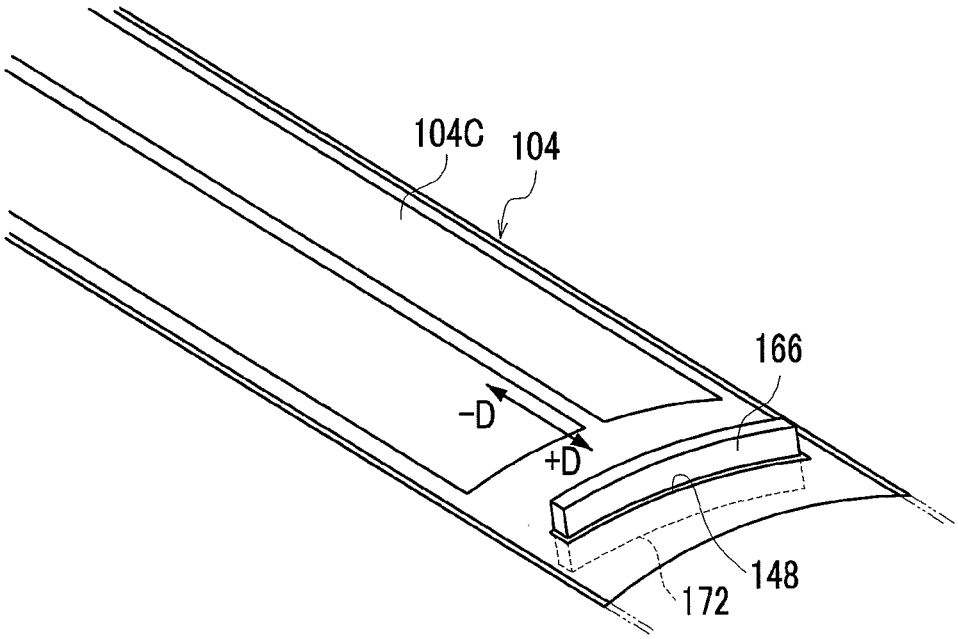
FIGS. 11A and 11B are perspective views illustrating a state where the cleaning pad cleans the grid electrode according to the exemplary embodiment of the invention.

As shown in FIGS. 10A and 11A, the cleaning pad 166 and the cleaning pad 172 have the same installation position in the arrow +D direction, and are disposed so as to opposite to each other in the vertical direction. In addition, the grid cleaning portion 150 is disposed at the non-electrode portion 104D which is a stand-by position when an image is formed in the image forming apparatus 10 (refer to FIG. 1). Further, since, at the stand-by position, the grid cleaning portion 150 is disposed outside of the axis direction of the photoreceptor 62 (denoted by the two-dot chain line) in the arrow +D direction, it does not come into contact with the photoreceptor 62.

When the grid cleaning portion 150 is located at the stand-by position, the cleaning pad 166 and the cleaning pad 172 are disposed at a stand-by position which is inside of the through-hole 148. In addition, at the stand-by position, the lower surface of the cleaning pad 166 comes into contact with the upper surface of the cleaning pad 172.

Here, the reason why the charging unit 100 is moved to the second position spaced from the photoreceptor 62 when cleaning the grid electrode 104 is as follows.

That is to say, as in the exemplary embodiment, if the grid electrode 104 is curved, the photoreceptor 62 and the grid electrode 104 have the gap d in an overall range. In other words, if a gap between the photoreceptor 62 and the grid electrode 104 is about 1 mm, a gap between the photoreceptor 62 and the grid electrode 104 is about 1 mm in an overall range. In contrast, in a case where the grid electrode has a flat plate shape, since a gap between them increases from the center of the grid electrode to the ends thereof in the transverse direction, the gap is 1 mm at the center but is 2 to 3 mm at the ends.

Therefore, as in the exemplary embodiment, it is difficult to secure a space for disposing constituent elements of the cleaning member between the grid electrode 104 and the photoreceptor 62 in the curved grid electrode 104.

Accordingly, when the grid electrode 104 is cleaned, the gap between the grid electrode 104 and the photoreceptor 62 increases by moving the charging unit 100 to the second position spaced from the photoreceptor 62.

Figure 12:
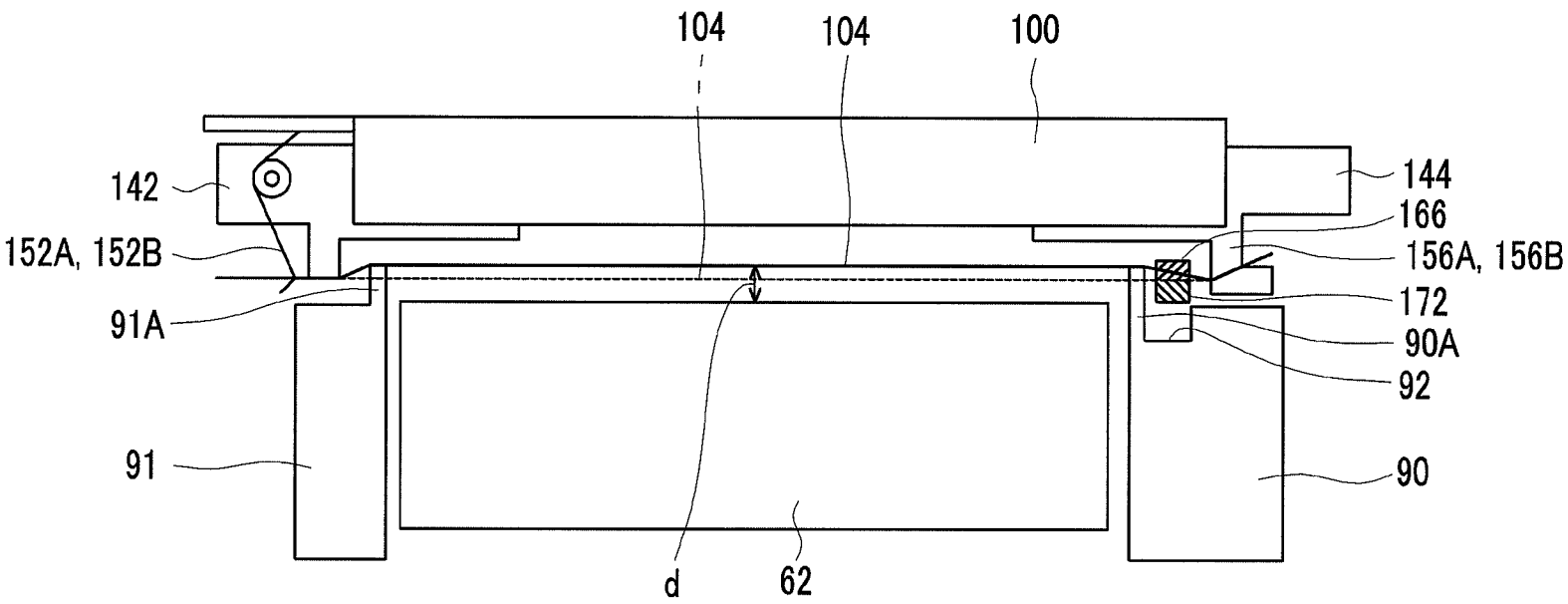
FIG. 12 is a diagram illustrating a case where the charging unit and the photoreceptor according to the exemplary embodiment of the invention are located at a first position.

Here, as shown in FIG. 12, the housing 90 supporting the photoreceptor 62 is provided with an engagement portion 92 into which the cleaning pad 166 and the cleaning pad 172 as a cleaning member located at the stand-by position are engaged at the first position which is a position where the charging unit 100 charges the outer circumferential surface of the photoreceptor 62.

As described above, since the gap between the photoreceptor 62 and the grid electrode 104 is very small, the gap between the housing 90 supporting the photoreceptor and the grid electrode 104 is also small. For this reason, the cleaning pad 166 and the cleaning pad 172 located at the stand-by position of the grid electrode 104 are engaged into the engagement portion 92, thereby preventing interference with the housing 90.

In addition, since the engagement portion 92 is formed at the opposite side (that is, outside) to the photoreceptor 62 with respect to the above-described rib 90A, when the charging unit 100 is located at the first position, the cleaning pads 166 and 172 are not moved to the photoreceptor 62 side due to the presence of the rib 90A. Therefore, the photoreceptor 62 is not damaged by the cleaning pads 166 and 172.

Next, an operation of the exemplary embodiment will be described.

When the grid electrode 104 is cleaned in the image forming apparatus 10 (refer to FIG. 1), as shown in FIGS. 5A and 5B, the control portion 20 (refer to FIG. 1) drives the motor 132 such that the slide members 126 and 128 are moved in the arrow +D direction and the guide rails 109 and 111 rise in the arrow UP direction. Thereby, the charging unit 100 is moved from the first position (FIG. 12) which is a position where the outer circumferential surface of the photoreceptor 62 may be charged to the second position (FIG. 13) which is a position further spaced from the photoreceptor 62 than the first position.

Figure 10B:
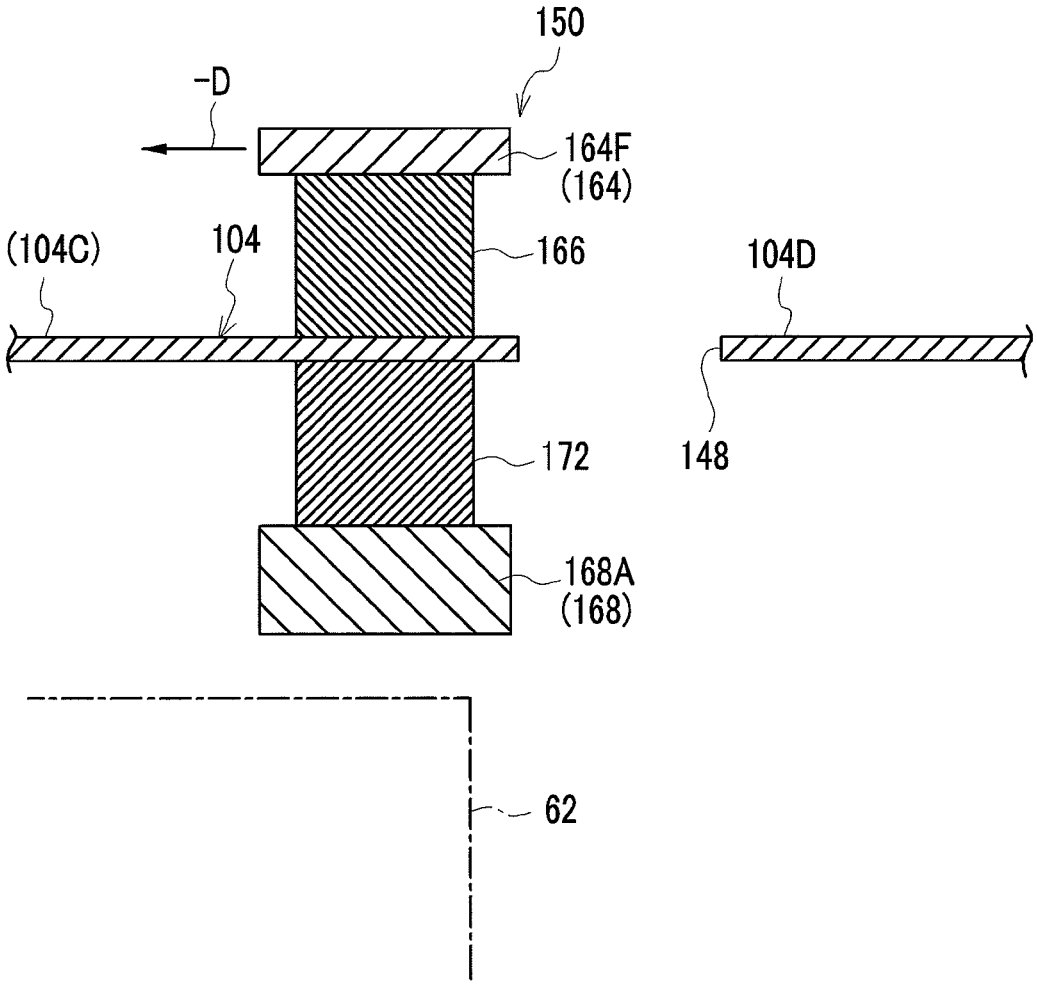
Figure 11B:
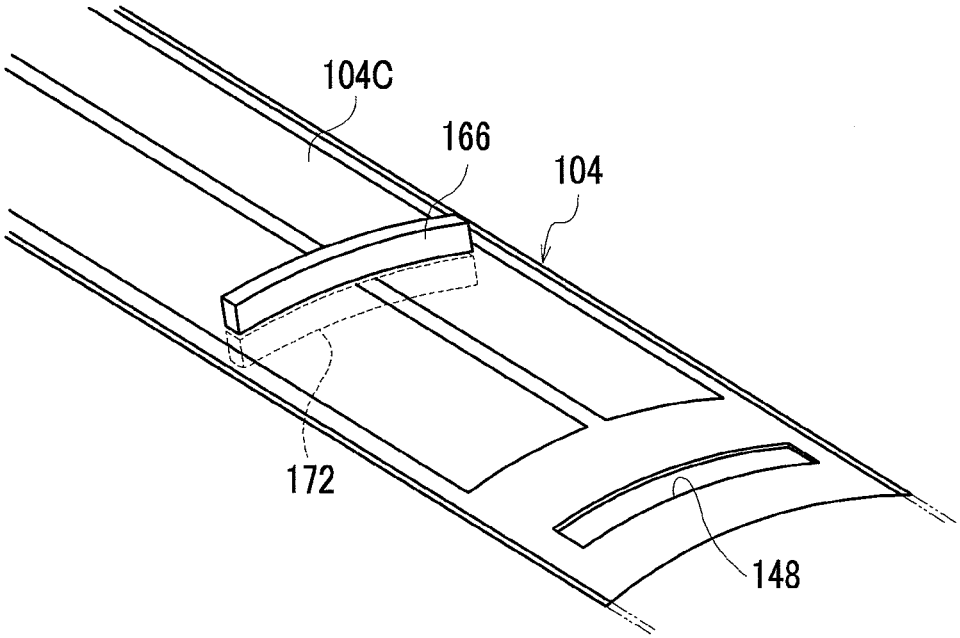
Figure 14:
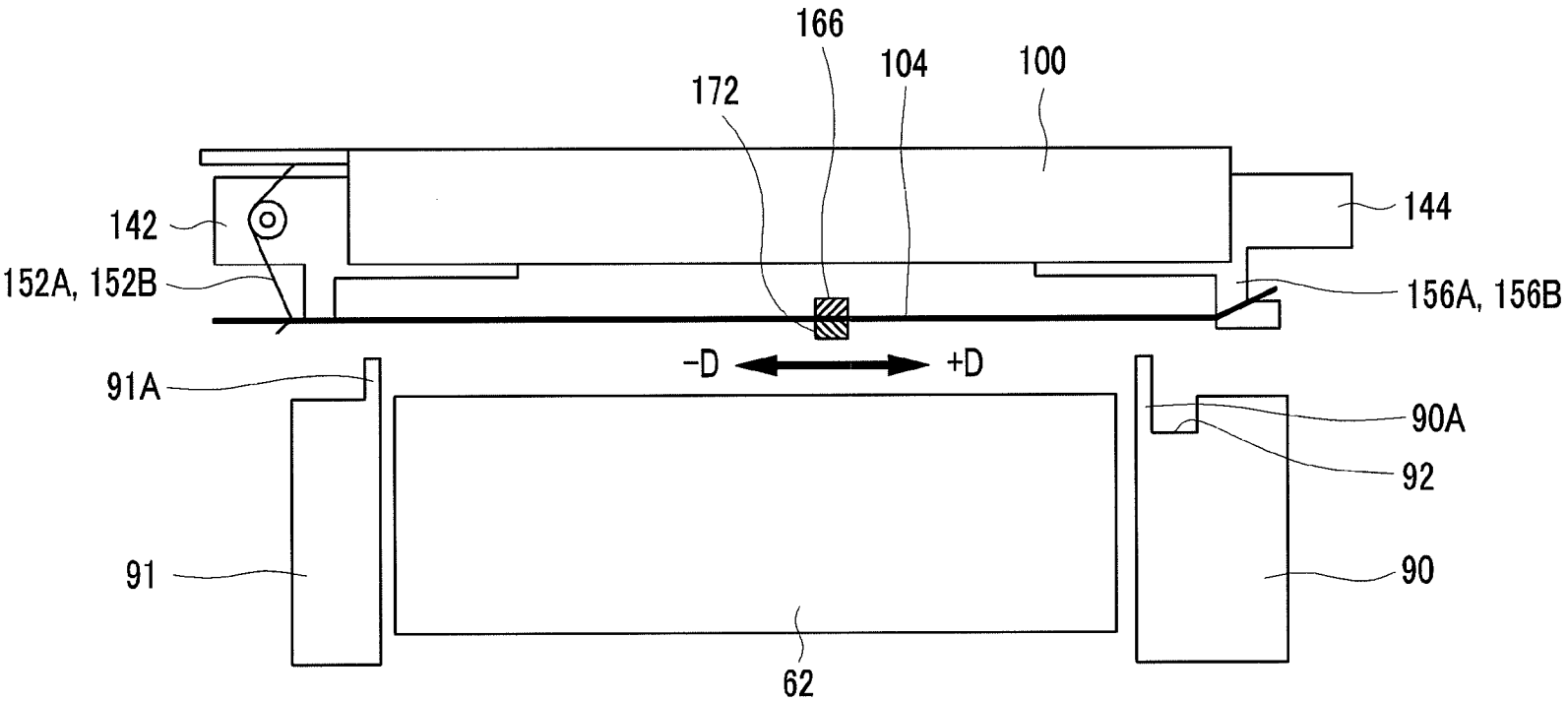
FIG. 14 is a diagram illustrating a case where the grid electrode is cleaned when the charging unit and the photoreceptor according to the exemplary embodiment of the invention are located at the second position.

Next, as shown in FIGS. 10B and 11B, when the lead shaft 170 (refer to FIG. 9A) is normally rotated, the grid cleaning portion 150 is moved in the arrow −D direction from the stand-by position. In addition, along with the movement of the grid cleaning portion 150, the cleaning pad 166 is moved in the arrow −D direction while coming into contact with the upper surface of the grid electrode 104 in a state of being inserted between and compressed by the recessed portion 164F and the upper surface of the grid electrode 104. Further, the cleaning pad 172 is moved in the arrow −D direction while coming into contact with the lower surface of the grid electrode 104 in a state of being inserted between and compressed by the convex portion 168A and the lower surface of the grid electrode 104. The grid cleaning portion 150 reaches one end of the grid electrode 104, and then is moved in the arrow +D direction. Thereby, the cleaning pads 166 and 172 remove toner or corona products attached to the electrode portion 104C, thereby cleaning the grid electrode 104 (FIG. 14).

Figure 13:
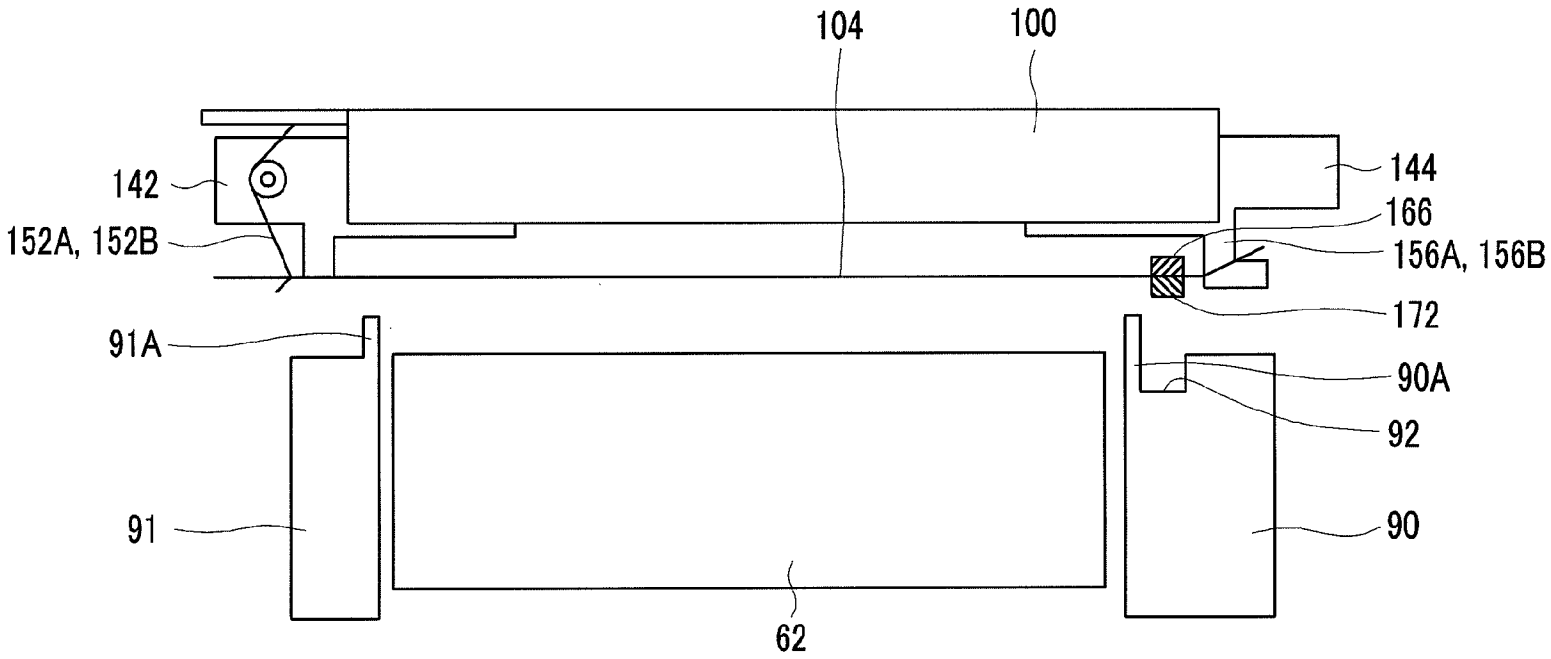
FIG. 13 is a diagram illustrating a case where the charging unit and the photoreceptor according to the exemplary embodiment of the invention are located at a second position.

On the other hand, as shown in FIGS. 10A and 11A, when cleaning of the grid electrode 104 is completed, the grid cleaning portion 150 returns to the stand-by position (FIG. 13). In addition, as shown in FIGS. 5A and 5B, when the control portion 20 (refer to FIG. 1) reversely drives the motor 132, the slide members 126 and 128 are moved in the arrow −D direction, and the guide rails 109 and 111 are moved downward. Thereby, the charging unit 100 returns to the first position which is a position where the outer circumferential surface of the photoreceptor 62 may be charged (FIG. 12).

Further, since the charging unit 100 returns to the first position with this operation, as long as the cleaning pads 166 and 172 do not return to the stand-by position, that is, when the cleaning pads 166 and 172 are located at the position where the grid electrode 104 is cleaned, the charging unit 100 is not located at the first position. Therefore, there is no case where the photoreceptor 62 is damaged by the cleaning pads 166 and 172 since the charging unit 100 returns to the first position when the cleaning pads 166 and 172 clean the grid electrode 104.

As such, the charging unit 100 is located at the first position for charging the photoreceptor 62, and the charging unit 100 is moved to the second position through rising of the guide rails 109 and 111 in a case where the grid electrode 104 is cleaned by the cleaning pads 166 and 172. Therefore, when the grid electrode 104 is cleaned, a gap between the grid electrode 104 and the photoreceptor 62 is sufficiently secured. Thereby, a dimensional limitation disappears in disposing the cleaning member, and thus cleaning performance of the control electrode is improved by the cleaning member.

As above, although the invention made by the present inventor has been described in detail based on the exemplary embodiment, it is to be understood that the exemplary embodiment disclosed in the specification is only an example, and the invention is not limited to the disclosed techniques. That is to say, it is natural that the technical scope of the present invention is not construed as being limited based on the description in the exemplary embodiment but is construed according to the recitation of the claims, and it includes techniques equivalent to the techniques recited in the claims and all the modifications that fall within the spirit of the claims.

For example, although, in the above description, the grid electrode 104, more accurately, the non-electrode portion 104B, the electrode portion 104C, and the non-electrode portion 104D of the grid electrode 104 are curved in a convex shape toward the charge wires 102A and 102B in order to increase a charging speed of the photoreceptor 62, they may not be curved, that is, be planarized.

Further, although, in the grid cleaning portion 150, the cleaning pad 166 and the cleaning pad 172 are provided at both sides with the grid electrode 104 interposed therebetween in the thickness direction so as to clean both the surfaces of the grid electrode 104, and thus the grid electrode 104 is more tidily cleaned, only one of the cleaning pad 166 or the cleaning pad 172 may be provided so as to clean only the upper surface or only the lower surface of the grid electrode 104.

In addition, although the through-hole 148 is formed at the stand-by position of the grid cleaning portion 150, the through-hole 148 may be omitted.

The upper end surfaces of the ribs 90A and 91A are not necessarily curved continuously, but may be curved totally by intermittent protrusions.

The image forming apparatus according to the exemplary embodiment of the invention can select recording types freely, and, may be applied to various image forming apparatuses which perform recording using toner such as, for example, a tandem type image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image forming portion that includes a cylindrical latent image supporting body, and a supporting member disposed at both ends of the latent image supporting body and rotatably supporting the latent image supporting body;

a charging unit that includes a discharge electrode supplying electric charge to the latent image supporting body due to discharge, and a control electrode disposed between the discharge electrode and the latent image supporting body and controlling a potential of the latent image supporting body, and that charges an outer circumferential surface of the latent image supporting body with a preset potential;

a cleaning member located at one end of the control electrode in a stand-by position and is reciprocally moved along an axis direction of the latent image supporting body to clean the control electrode as it comes into contact with the control electrode; and a movement portion that moves the charging unit to a first position with respect to the latent image forming portion when charging the latent image supporting body, and moves the charging unit to a second position which is farther spaced from the latent image forming portion than the first position when the control electrode is cleaned by the cleaning member, wherein the supporting member is provided with a pressing portion, and the control electrode being configured to contact the pressing portion of the supporting member when the charging unit is located at the first position, and wherein the control electrode being configured to not contact the pressing portion when the charging unit is located at the second position, wherein an engagement portion is provided on an outer surface of the supporting member on one side of the supporting member and is located on an outer side of the latent image supporting body with respect to the pressing member, and wherein in the stand-by position at least a part of the cleaning member is engaged into the engagement portion of the supporting member to avoid interference with the supporting member, wherein at least one end of the control electrode has a through hole configured to accept the cleaning member in the stand-by position.

2. The image forming apparatus according to claim 1, wherein the cleaning member is provided at both sides of the control electrode interposed therebetween in a thickness direction.

3. The image forming apparatus according to claim 1, wherein the engagement portion is formed at an opposite side to the latent image supporting body with respect to the pressing portion.

4. The image forming apparatus according to claim 1, wherein in the stand-by position of the cleaning member, the cleaning member is located at a side of the pressing portion opposite from the latent image supporting body in a moving direction of the cleaning member.

5. The image forming apparatus according to claim 1, wherein the pressing portion is configured to block the cleaning member from moving towards to the latent image supporting body when the charging unit is located at the first position.

6. The image forming apparatus according to claim 1, wherein a portion of the supporting member is located on an outer side and an inner side of the cleaning member when the cleaning member is engaged in the engagement portion.

7. An image forming apparatus comprising:

a latent image forming portion that includes a cylindrical latent image supporting body, and a supporting member disposed at both ends of the latent image supporting body and rotatably supporting the latent image supporting body;

a charging unit that includes a discharge electrode supplying electric charge to the latent image supporting body due to discharge, and a control electrode disposed between the discharge electrode and the latent image supporting body and controlling a potential of the latent image supporting body, and that charges an outer circumferential surface of the latent image supporting body with a preset potential;

a cleaning member located at one end of the control electrode in a stand-by position and is reciprocally moved along an axis direction of the latent image supporting body to clean the control electrode as it comes into contact with the control electrode; and a movement portion that moves the charging unit to a first position with respect to the latent image forming portion when charging the latent image supporting body, and moves the charging unit to a second position which is farther spaced from the latent image forming portion than the first position when the control electrode is cleaned by the cleaning member, wherein the supporting member is provided with a pressing portion, and the control electrode being configured to contact the pressing portion of the supporting member when the charging unit is located at the first position, and wherein the control electrode being configured to not contact the pressing portion when the charging unit is located at the second position, wherein an engagement portion is provided on an outer surface of the supporting member on one side of the supporting member and is located on an outer side of the latent image supporting body with respect to the pressing member, and wherein in the stand by position at least a part of the cleaning member is engaged into the engagement portion of the supporting member to avoid interference with the supporting member, wherein the supporting member has an outer wall and an inner wall separated by the engagement portion and connected by a bottom wall, the outer wall and the inner wall extending upwardly from the bottom wall, and the inner wall having a height taller than the outer wall.

* * * * *